US011854498B2

(12) United States Patent
Shin

(10) Patent No.: US 11,854,498 B2
(45) Date of Patent: Dec. 26, 2023

(54) DISPLAY DEVICE HAVING A PLURALITY OF SUB-PIXELS FOR DISPLAYING ODD OR EVEN NUMBERED GRAYSCALE LEVELS

(71) Applicant: LG Display Co., Ltd., Seoul (KR)

(72) Inventor: Seunghwan Shin, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 18/056,211

(22) Filed: Nov. 16, 2022

(65) Prior Publication Data

US 2023/0178035 A1 Jun. 8, 2023

(30) Foreign Application Priority Data

Dec. 8, 2021 (KR) ..... 10-2021-0174685

(51) Int. Cl.
*G09G 3/3291* (2016.01)
*G09G 3/32* (2016.01)

(52) U.S. Cl.
CPC ..... *G09G 3/3291* (2013.01); *G09G 3/32* (2013.01); *G09G 2300/0842* (2013.01); *G09G 2310/027* (2013.01)

(58) Field of Classification Search
CPC ..... G09G 3/3291
USPC ..... 345/204
See application file for complete search history.

(56) References Cited

U.S. PATENT DOCUMENTS

2006/0208983 A1 9/2006 Lee et al.
2007/0002084 A1* 1/2007 Kimura ..... H10K 59/352 345/694
2021/0358377 A1* 11/2021 Higashikawa ..... G09G 3/006

FOREIGN PATENT DOCUMENTS

KR 10-0910557 B1 8/2009

* cited by examiner

*Primary Examiner* — Long D Pham
(74) *Attorney, Agent, or Firm* — Seed IP Law Group LLP

(57) ABSTRACT

According to an aspect of the present disclosure, a display device includes a display panel which includes sub pixels configured by an upper sub pixel and a lower sub pixel which share a data line and are adjacent to each other; and a data driver which converts only image data corresponding to any one of even-numbered grayscale levels and odd-numbered grayscale levels among 10-bit image data into a data voltage to supply the converted data voltage to the sub pixel, in which when the data driver converts only the even-numbered grayscale levels of image data into the data voltage and the sub pixel displays an X (X is an odd number) grayscale level, the data driver supplies an X−1 grayscale level of data voltage to the upper sub pixel and supplies an X+1 grayscale level of data voltage to the lower sub pixel.

21 Claims, 15 Drawing Sheets

SP(SPa,SPb)

DISPLAY DEVICE HAVING A PLURALITY OF SUB-PIXELS FOR DISPLAYING ODD OR EVEN NUMBERED GRAYSCALE LEVELS

CROSS-REFERENCE TO RELATED APPLICATIONS

This application claims the priority of Korean Patent Application No. 10-2021-0174685 filed on Dec. 8, 2021, in the Korean Intellectual Property Office, the disclosure of which is incorporated herein by reference.

BACKGROUND

Technical Field

The present disclosure relates to a display device, and more particularly, to a display device which is capable of reducing a size of a data driver and a manufacturing cost by composing gray scales between sub pixels.

Description of the Related Art

As display devices which are used for a monitor of a computer, a television, or a cellular phone, there are an organic light emitting display (OLED) device which is a self-emitting device and a liquid crystal display (LCD) device which requires a separate light source.

An applicable range of the display device is diversified to personal digital assistants as well as monitors of computers and televisions and a display device with a large display area and a reduced volume and weight is being studied.

In the meantime, the data driver includes a digital to analog converter (DAC) which converts image data which is a digital signal input from the outside into an analog data voltage. However, in recent years, there are problems in that a number of bits of image data is increased in accordance with the increase of the resolution and a size of the DAC and the data driver for converting the image data and the manufacturing cost thereof are increased.

BRIEF SUMMARY

A technical benefit to be achieved by the present disclosure is to provide a display device which increases a grayscale range to be expressed by composing gray scales of two sub pixels.

Another technical benefit to be achieved by the present disclosure is to provide a display device which is capable of displaying 10-bit image data by composing gray scales between sub pixels when a DAC which is capable of converting 9-bit image data is used.

Still another technical benefit to be achieved by the present disclosure is to provide a display device which is capable of maintaining a display quality while changing a DAC of the data driver to a low specification.

Still another technical benefit to be achieved by the present disclosure is to provide a display device which increases a number of sub pixels connected to one data line so that when gray scales are composed, the display quality degradation is minimized or reduced.

Still another technical benefit to be achieved by the present disclosure is to provide a display device which ensures a driving time by means of overlap-driving between sub pixels which are vertically adjacent.

Technical benefits of the present disclosure are not limited to the above-mentioned technical benefit, and other technical benefit, which are not mentioned above, can be clearly understood by those skilled in the art from the following descriptions.

In order to achieve the above-described technical benefit, according to an aspect of the present disclosure, a display device includes a display panel which includes a plurality of sub pixels, each including an upper sub pixel and a lower sub pixel which share a data line and are adjacent to each other; and a data driver which converts only image data corresponding to any one of even-numbered grayscale levels and odd-numbered grayscale levels among 10-bit image data into a converted data voltage, and supplies the converted data voltage to the plurality of sub pixels, in which when the data driver converts only the even-numbered grayscale levels of image data into the data voltage and the sub pixel displays an X (X is an odd number) grayscale level, the data driver supplies an X−1 grayscale level of data voltage to the upper sub pixel and supplies an X+1 grayscale level of the data voltage to the lower sub pixel. Accordingly, according to the present disclosure, various gray scales can be displayed by composing different gray scales displayed in the upper sub pixel and the lower sub pixel, so an image with a high resolution can be displayed even using a data driver with a low specification.

According to another aspect of the present disclosure, a display device includes: a display panel which includes a plurality of sub pixels, each including an upper sub pixel and a lower sub pixel which share a data line and are adjacent to each other and displays an image based on n-bit image data input from the outside (n is a natural number), in which only some image data among the n-bit image data input from outside the display panel is converted into m-bit image data (m is a natural number smaller than n) to be output to the upper sub pixel and the lower sub pixel and the plurality of sub pixels display a gray scale corresponding to n-bit image data. Accordingly, according to the present disclosure, even though only a data voltage of m-bit image data is output to the display panel, the gray scale displayed in the upper sub pixel and the lower sub pixel are composed to display a gray scale corresponding to the n-bit image data.

Other detailed matters of the example embodiments are included in the detailed description and the drawings.

According to the present disclosure, gray scales which are displayed in adjacent sub pixels are composed to express various gray scales.

According to the present disclosure, when a DAC which is capable of converting up to 9 bit digital signal is used, gray scales of an upper sub pixel and a lower sub pixel are composed to display 10-bit image data.

According to the present disclosure, even though the DAC of the data driver is changed to a low specification, the display quality of the display device can be maintained.

According to the present disclosure, the number of sub pixels connected to one data line is increased to suppress the degradation of the display quality due to the gray scale composition.

According to the present disclosure, sub pixels connected to one data line are overlap-driven so that even though the number of sub pixels is increased, the driving time of each of sub pixels can be sufficiently ensured.

The effects according to the present disclosure are not limited to the contents exemplified above, and more various effects are included in the present specification.

BRIEF DESCRIPTION OF THE SEVERAL VIEWS OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
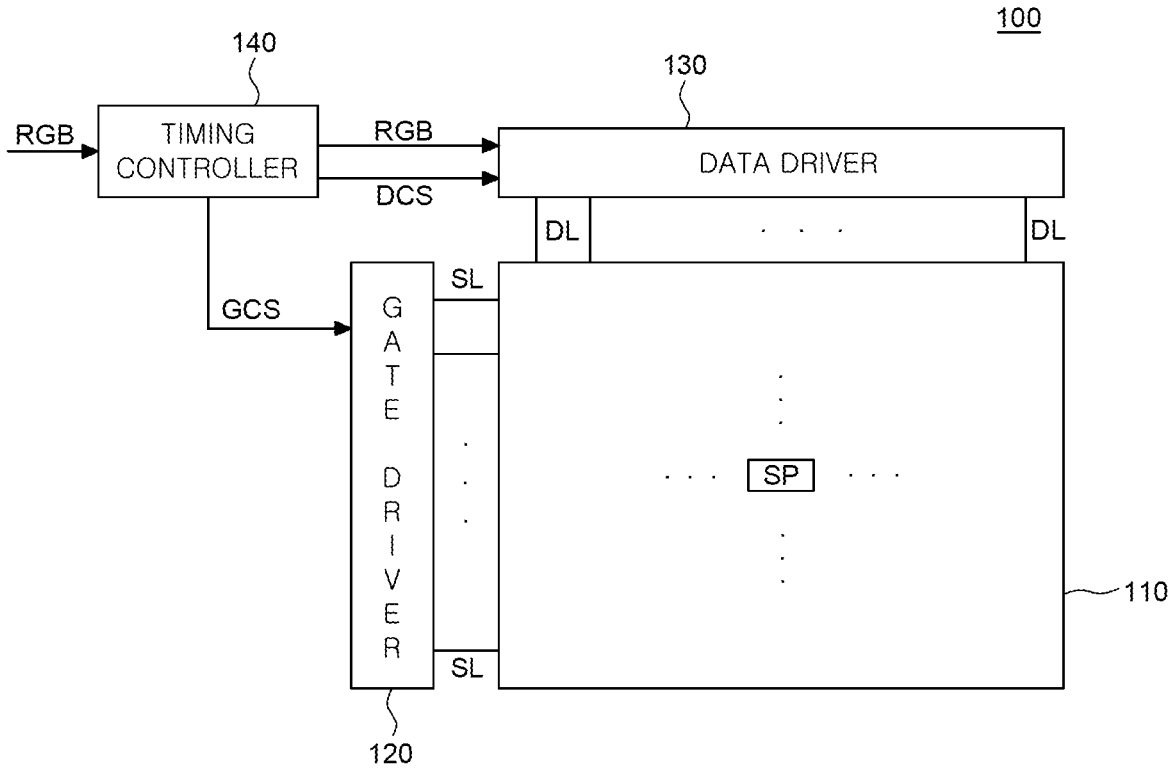
FIG. 1 is a schematic diagram of a display device according to an example embodiment of the present disclosure.

Advantages and characteristics of the present disclosure and a method of achieving the advantages and characteristics will be clear by referring to example embodiments described below in detail together with the accompanying drawings. However, the present disclosure is not limited to the example embodiments disclosed herein but will be implemented in various forms. The example embodiments are provided by way of example only so that those skilled in the art can fully understand the disclosures of the present disclosure and the scope of the present disclosure.

The shapes, sizes, ratios, angles, numbers, and the like illustrated in the accompanying drawings for describing the example embodiments of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on," "above," "below," and "next," one or more parts may be positioned between the two parts unless the terms are used with the term "immediately" or "directly."

When an element or layer is disposed "on" another element or layer, another layer or another element may be interposed directly on the other element or therebetween.

Although the terms "first," "second," and the like are used for describing various components, these components are not confined by these terms. These terms are merely used for distinguishing one component from the other components. Therefore, a first component to be mentioned below may be a second component in a technical concept of the present disclosure.

Like reference numerals generally denote like elements throughout the specification.

A size and a thickness of each component illustrated in the drawing are illustrated for convenience of description, and the present disclosure is not limited to the size and the thickness of the component illustrated.

The features of various embodiments of the present disclosure can be partially or entirely adhered to or combined with each other and can be interlocked and operated in technically various ways, and the embodiments can be carried out independently of or in association with each other.

Hereinafter, a display device according to example embodiments of the present disclosure will be described in detail with reference to accompanying drawings.

FIG. 1 is a schematic diagram of a display device according to an example embodiment of the present disclosure. In FIG. 1, for the convenience of description, among various components of the display device 100, only a display panel 110, a gate driver 120, a data driver 130, and a timing controller 140 are illustrated, and other components may be omitted from view.

Referring to FIG. 1, the display device 100 includes a display panel 110 including a plurality of sub pixels SP, a gate driver 120 and a data driver 130 which supply various signals to the display panel 110, and a timing controller 140 which controls the gate driver 120 and the data driver 130.

The gate driver 120 supplies scan signals to a plurality of scan lines SL in accordance with a plurality of gate control signals GCS supplied from the timing controller 140. Even though in FIG. 1, it is illustrated that one gate driver 120 is disposed to be spaced apart from one side of the display panel 110, the number of the gate drivers 120 and the placement thereof are not limited thereto.

The data driver 130 converts image data RGB input from the timing controller 140 in accordance with a plurality of data control signals DCS supplied from the timing controller 140 into a data voltage Vdata using a gamma voltage. The data driver 130 receives the gamma voltage from a gamma unit or circuit to select a gamma voltage corresponding to a gray scale of the image data RGB among the received gamma voltages to generate a data voltage Vdata and to supply the generated data voltage Vdata to a plurality of data lines DL.

The timing controller 140 aligns image data RGB input from the outside to supply the image data to the data driver 130. The timing controller 140 may generate a gate control signal GCS and a data control signal DCS using synchronization signals input from the outside, such as a dot clock signal, a data enable signal, and horizontal/vertical synchronization signals. The timing controller 140 supplies the generated gate control signal GCS and the data control signal DCS to the gate driver 120 and the data driver 130, respectively, to control the gate driver 120 and the data driver 130.

The display panel 110 is a configuration which displays images to the user and includes the plurality of sub pixels SP. In the display panel 110, the plurality of scan lines SL and the plurality of data lines DL overlap each other and the plurality of sub pixels SP is connected to the scan lines SL and the data lines DL, respectively. In addition, a high potential power voltage and a low potential power voltage may be supplied to each of the plurality of sub pixels SP which will be described in more detail below with reference to FIG. 3.

The plurality of sub pixels SP is a minimum unit which configures a screen and several sub pixels SP are gathered to form one pixel. Each of the plurality of sub pixels SP includes a light emitting element and a pixel circuit for driving the light emitting element. The plurality of light emitting elements may have different structure and components depending on the type of the display panel 110. For example, when the display panel 110 is an OLED panel, the light emitting element may be an OLED element which includes an anode, an organic light emitting layer, and a cathode. In addition to this, as the light emitting element, a light emitting diode (LED) or a quantum dot light-emitting diode (QLED) including quantum dot (QD) may be further used.

In the meantime, according to the number of bits of a digital signal which is convertible into a data voltage Vdata in the digital to analog converter DAC, a gray scale to be expressed in the display panel 110 may be determined within a predetermined or selected range. For example, when the digital to analog converter DAC converts 9-bit image data RGB into an analog data voltage Vdata, the display panel 110 may express 0 to 511 gray scale levels (e.g., 0, 1, 2, . . . , 510, 511) which can be expressed by 9 bits. For example, when the digital to analog converter DAC converts 10-bit image data RGB into an analog data voltage Vdata, the display panel 110 may express 0 to 1023 (e.g., 0, 1, 2, . . . , 1022, 1023) gray scale levels which can be expressed by 10 bits.

At this time, the display device 100 according to an example embodiment of the present disclosure may express gray scale more than the gray scale which can be expressed by m bits even using the digital to analog converter DAC which can convert up to m-bit digital signal (m is a natural number). Specifically, when image data RGB input to the display device 100 from the outside is n-bit image data RGB (n is a natural number), the data driver 130 includes a digital to analog converter (DAC) which is capable of converting to an m-bit digital signal (m is a natural number which is smaller than n). In this case, only some image data RGB among n-bit image data RGB is converted into m-bit image data RGB to be supplied to the data driver 130 and the sub pixel SP so as to convert the data voltage Vdata in the data driver 130. Further, gray scales expressed in each of the sub pixels SP are composed to express grayscale levels more than the gray scale levels which can be expressed by m bits. For example, when the digital to analog converter DAC is capable of converting up to a 9-bit digital signal into an analog data voltage Vdata, the gray scales displayed in the sub pixel SP are composed to express grayscale levels more than 0 to 511 grayscale levels. Therefore, the display device 100 according to an example embodiment of the present disclosure may display various grayscale images without using a digital to analog converter DAC having a high specification which converts a more number of bits of digital signal and may reduce a size and a cost of the data converter 130.

At this time, in order to compose the gray scales between the plurality of sub pixels SP without degrading a resolution of the display panel 110, each sub pixels SP is configured by a pair of an upper sub pixel and a lower sub pixel. Only some image data RGB, among n-bit image data RGB input from the outside, is converted into m-bit image data RGB to be output to each of the upper sub pixel and the lower sub pixel. The sub pixels SP configured by the upper sub pixel and the lower sub pixel compose the gray scales of the upper sub pixel and the lower sub pixel to display a gray scale corresponding to n-bit image data.

As the sub pixel SP is configured by two of the upper sub pixel and the lower sub pixel for composing the gray scales to increase the number of entire sub pixels SP, the upper sub pixel and the lower sub pixel are overlap-driven to ensure a driving time of each sub pixel SP. A detailed description thereof will be made below.

Hereinafter, for the convenience of description, it is assumed that the digital to analog converter DAC converts 9-bit image data RGB and the display panel 110 displays 0 to 1023 grayscale levels which can be expressed by 10 bits, but it is not limited thereto.

Next, a driving method of displaying various gray scales by composing gray scales of two sub pixels SP will be described with reference to FIGS. 2A and 2B.

Figure 2A:
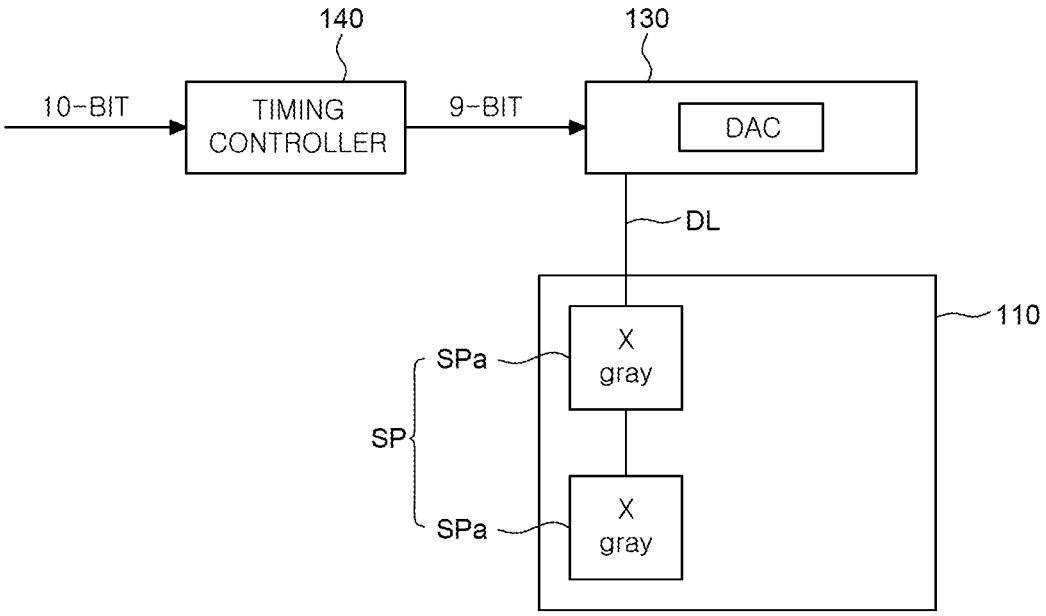
FIGS. 2A to 2B are schematic diagrams for explaining a grayscale expressing method of a display device according to an example embodiment of the present disclosure.
Figure 2B:
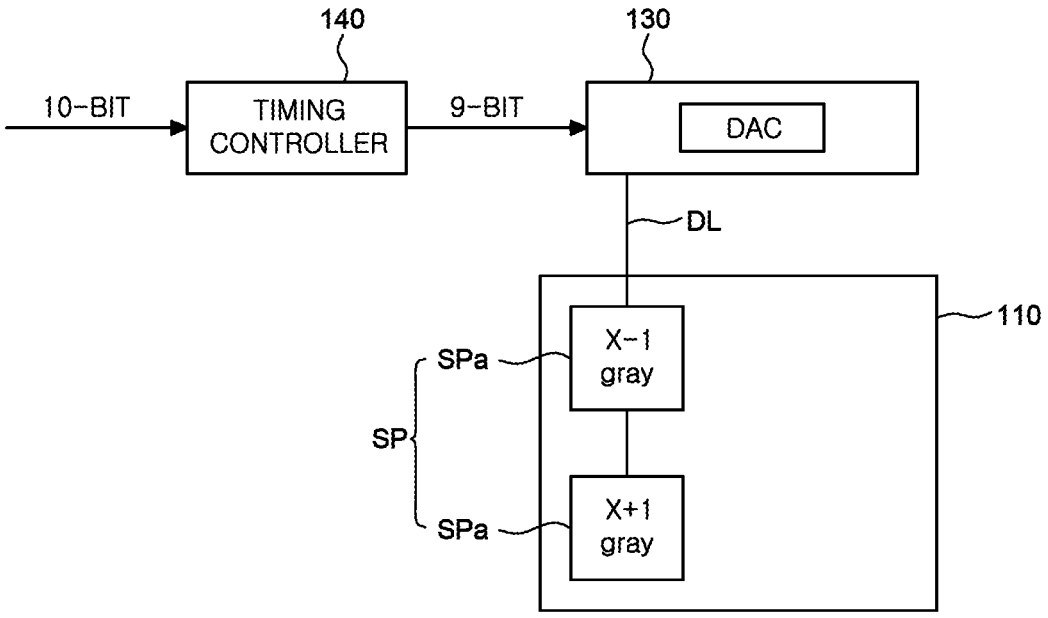

FIGS. 2A and 2B are schematic diagrams for explaining a grayscale expressing method of a display device according to an example embodiment of the present disclosure.

Figure 10:
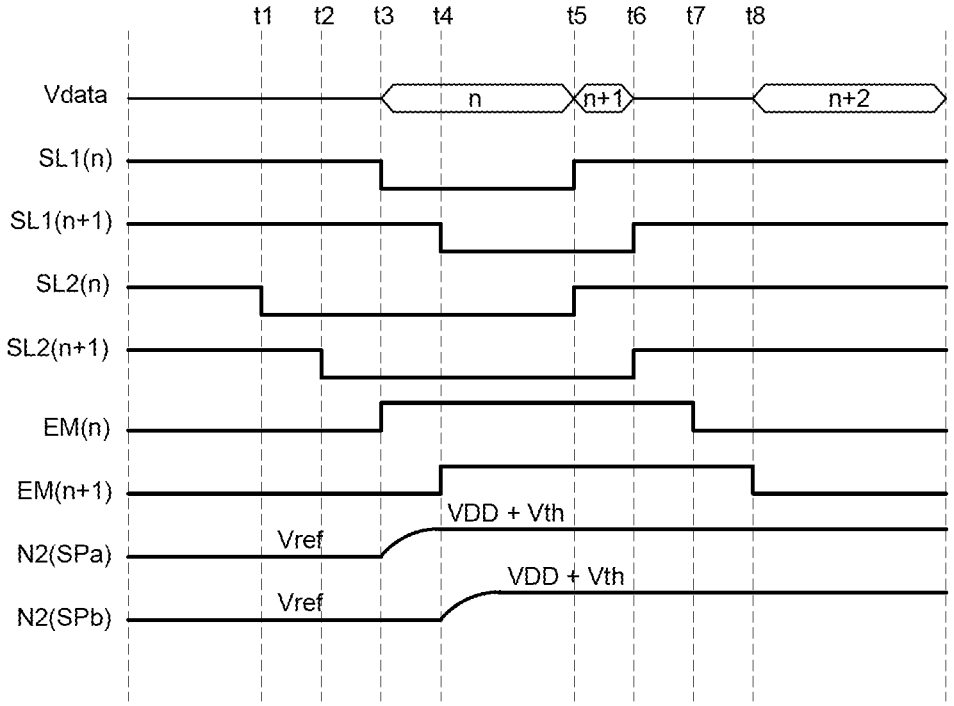
FIG. 10 is a driving timing diagram of an upper sub pixel and a lower sub pixel of a display device according to still another example embodiment of the present disclosure.

Referring to FIG. 2A, 10-bit image data RGB is input to the timing controller 140 from the outside. The timing controller 140 converts 10-bit image data RGB into 9-bit image data RGB to provide the converted 9-bit image data RGB to the digital to analog converter DAC of the data driver 130.

At this time, 9-bit image data RGB which expresses only 0 to 511 levels cannot express 0 to 1023 grayscale levels. However, the display device 100 according to an example embodiment of the present disclosure may represent only even-numbered or odd-numbered grayscale levels among the 0 to 1023 grayscale levels to the 0 to 511 levels of 9-bit signal. For example, each of even-numbered grayscale levels of 0, 2, 4, . . . , 1020, and 1022 among the 0 to 1023 levels may match each of the 0 to 511 levels of 9-bit image data RGB. Among the 0 to 1023 grayscale levels, there are a total of 512 even-numbered grayscale levels and a total of 512 odd-numbered grayscale levels. Therefore, 9-bit image data RGB which expresses 512 levels of the 0 to 511 levels may express 512 even-numbered grayscale levels or 512 odd-numbered grayscale levels. Each of 512 even-numbered grayscale levels or 512 odd-numbered grayscale levels among 0 to 1023 grayscale levels corresponding to 10-bit image data RGB are converted into each of 0 to 511 levels of 9-bit image data RGB to be output to the data driver 130. Therefore, the timing controller 140 converts 10-bit image data input from the outside into 9-bit image data RGB to provide the converted 9-bit image data to the data driver 130.

However, the 10-bit image data RGB is provided from the timing controller 140 to the data driver 130 and 10-bit image data RGB is converted into the 9-bit image data RGB in the data driver 130 to be provided to the digital to analog converter DAC, but is not limited thereto.

Accordingly, only odd-numbered or even-numbered grayscale levels, among 0 to 1023 grayscale levels which are expressed by 10 bits, are converted into 9-bit image data RGB to be provided to the data driver 130 and the digital to analog converter DAC may convert 9-bit image data RGB into an analog data voltage Vdata.

Hereinafter, for the convenience of description, it is assumed that even-numbered grayscale levels among 10-bit image data RGB matches 9-bit image data RGB.

In the meantime, each of the plurality of sub pixels SP may be configured by an upper sub pixel SPa and a lower sub pixel SPb to compose the gray scales. Gray scales of the upper sub pixel SPa and the lower sub pixel SPb which are adjacent to each other are composed to express 0 to 1023 grayscale levels.

The upper sub pixel SPa and the lower sub pixel SPb are connected to the same data line DL and are disposed to be adjacent to each other. The upper sub pixel SPa is a sub pixel to which data voltage Vdata is input earlier than the lower sub pixel SPb and the lower sub pixel SPb is a sub pixel to which the data voltage Vdata is input later than the upper sub pixel SPa. The upper sub pixel SPa and the lower sub pixel SPb are sub pixels which emit light having the same color and may express both the even-numbered grayscale levels and the odd-numbered grayscale levels using the gray scale expressed in each of the upper sub pixel SPa and the lower sub pixel SPb.

Referring to FIG. 2A, when X is an even-numbered grayscale level, image data RGB representing an X-grayscale level may be input to the digital to analog converter DAC. The digital to analog converter DAC converts the image data representing the X-grayscale level into an analog data voltage Vdata to supply the converted analog data voltage Vdata to each of the plurality of sub pixels SP. The data voltage Vdata which displays an X-grayscale level may be input to both the upper sub pixel SPa and the lower sub pixel SPb from the digital to analog converter DAC. Accordingly, both the upper sub pixel SPa and the lower sub pixel SPb express the X-grayscale level so that an image of an X-grayscale level may be displayed on the display device 100.

Referring to FIG. 2B, when X is an odd-numbered grayscale level, a lower grayscale level and a higher grayscale level than the X-grayscale level may be displayed in the upper sub pixel SPa and the lower sub pixel SPb, respectively, to display the X-grayscale level.

First, the 9-bit signal which can be converted by the digital to analog converter DAC includes 0 to 511 levels and 0 to 511 levels match only even-numbered grayscale levels among 0 to 1023 grayscale levels. Therefore, 0 to 511 levels of 9-bit signal which is transmitted to the digital to analog converter DAC cannot convert the X grayscale level which is an odd-numbered grayscale level into the analog data voltage Vdata. Therefore, 9-bit signals corresponding to an X−1 grayscale level which is a lower grayscale level than the X-grayscale level and an X+1 grayscale level which is a higher grayscale level than the X-grayscale level may be supplied to the digital to analog converter DAC. That is, instead of the odd-numbered grayscale level of image data RGB to be displayed, even-numbered grayscale levels before and after the odd-numbered grayscale level of image data RGB may be provided to the digital to analog converter DAC.

The digital to analog converter DAC may output an X−1 grayscale level of data voltage Vdata to the upper sub pixel SPa. The digital to analog converter DAC may output an X+1 grayscale level of data voltage Vdata to the lower sub pixel SPb. Since the upper sub pixel SPa displays the X−1 grayscale level and the lower sub pixel SPb displays the X+1 grayscale level so that the X−1 grayscale level and the X+1 grayscale level are composed to display an X grayscale level. For example, when 9 grayscale level is displayed, the digital to analog converter DAC outputs a data voltage Vdata corresponding to 8 grayscale level to the upper sub pixel SPa. And, the digital to analog converter DAC may output a data voltage Vdata corresponding to 10 grayscale level to the lower sub pixel SPb. Finally, 8 grayscale level of the upper sub pixel SPa and 10 grayscale level of the lower sub pixel SPb are composed so that it may be seen that one sub pixel SP expresses 9 grayscale levels.

In contrast, when the digital to analog converter DAC is designed to output only odd-numbered grayscale levels of data voltages Vdata, both the even-numbered grayscale levels and the odd-numbered grayscale levels may be expressed by the same method as described above. Specifically, when the odd-numbered grayscale levels are expressed, the digital to analog converter DAC may output a data voltage Vdata expressing the odd-numbered grayscale levels to both the upper sub pixel SPa and the lower sub pixel SPb. When the even-numbered grayscale levels are expressed, the digital to analog converter DAC outputs an odd-numbered grayscale level, which is lower than the even-numbered grayscale level, of data voltage Vdata to the upper sub pixel SPa and outputs an Odd-numbered grayscale level, which is higher than the even-numbered grayscale level, of data voltage Vdata to the lower sub pixel SPb.

Accordingly, when the display device 100 according to an example embodiment of the present disclosure uses a digital to analog converter DAC which can convert 9-bit image data RGB, in order to display 10-bit image data RGB, an even-numbered grayscale level of data voltage Vdata or an odd-numbered grayscale level of data voltage Vdata, among 0 to 1023 grayscale levels, is output. Further, each of gray scales of the upper sub pixel SPa and the lower sub pixel SPb is composed to express all 0 to 1023 grayscale levels of 10-bit image data RGB.

In the meantime, the even-numbered and odd-numbered grayscale level is expressed by composing gray scales of the upper sub pixel SPa and the lower sub pixel SPb so that the number of the plurality of sub pixels SP connected to one data line DL needs to be increased to implement an image quality of the related art. If a digital to analog converter DAC which can convert a 10-bit digital signal is used, one sub pixel SP may display one of 0 to 1023 grayscale levels. However, as in the display device 100 according to an example embodiment of the present disclosure, when the digital to analog converter DAC expresses 0 to 1023 grayscale levels corresponding to 10-bit image data RGB, two upper sub pixel SPa and lower sub pixel SPb express one gray scale. Accordingly, the display quality may not be degraded only when the number of sub pixels SP connected to one data line DL is doubled.

However, when the number of sub pixels SP or scan lines connected to one data line DL is doubled, in order to constantly maintain the driving speed of the display device 100, a scan signal output time and a time to input a signal to each of a plurality of sub pixels SP are inevitably reduced. Accordingly, it may be difficult to internally compensate for each of the sub pixels SP. Therefore, in the display device 100 according to an example embodiment of the present disclosure, the upper sub pixel SPa and the lower sub pixel SPb are overlap-driven to ensure a driving time beneficial to input various signals to each of a plurality of sub pixels SP and to compensate for various deviations.

Hereinafter, a driving method of a plurality of sub pixels SP will be described in detail with reference to FIGS. 3 to 5B.

Figure 3:
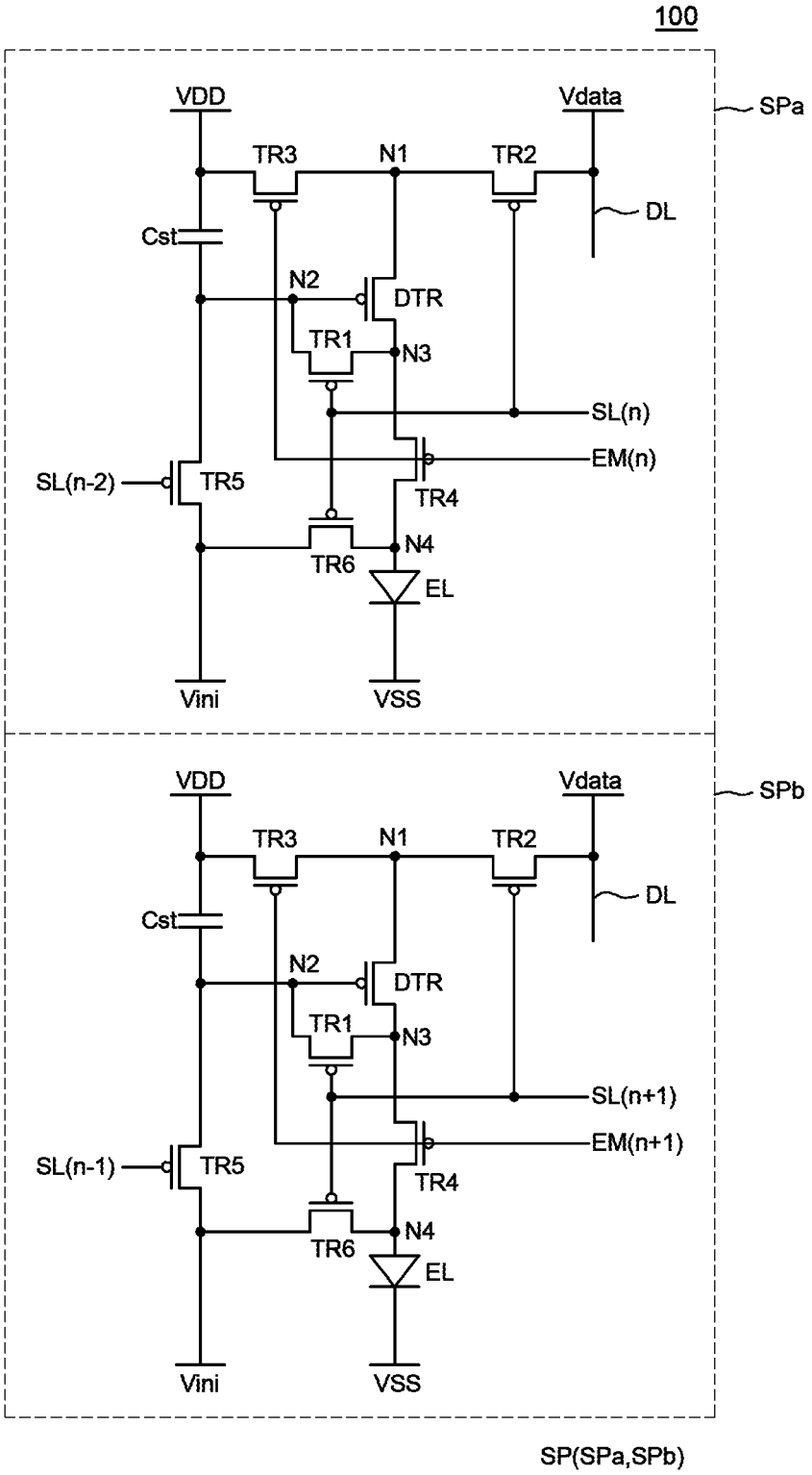
FIG. 3 is a circuit diagram of an upper sub pixel and a lower sub pixel of a display device according to an example embodiment of the present disclosure.
Figure 4:
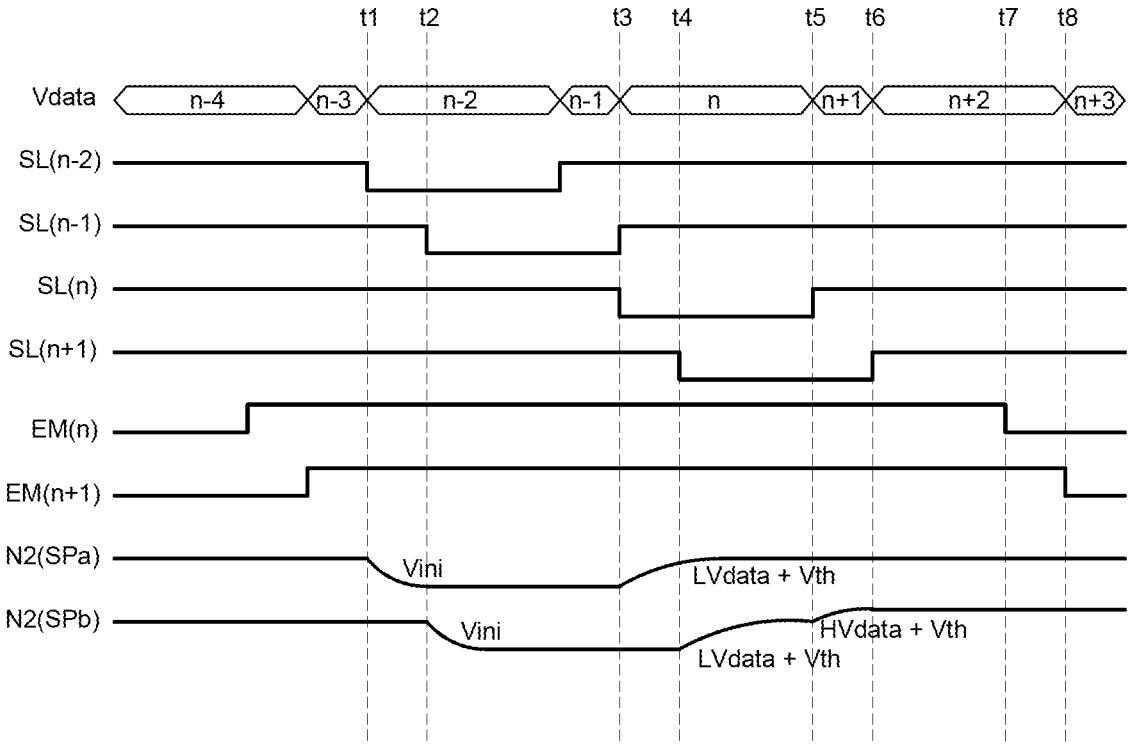
FIG. 4 is a driving timing diagram of an upper sub pixel and a lower sub pixel of a display device according to an example embodiment of the present disclosure.

FIG. 3 is a circuit diagram of an upper sub pixel and a lower sub pixel of a display device according to an example embodiment of the present disclosure. FIG. 4 is a driving timing diagram of an upper sub pixel and a lower sub pixel of a display device according to an example embodiment of the present disclosure. FIG. 4 is a timing diagram when a higher gray scale and a lower gray scale than a specific or selected gray scale are composed to express the specific or selected gray scale as illustrated in FIG. 2B. That is, FIG. 4 is a timing diagram when a lower gray scale of data voltage LVdata is input to the upper sub pixel SPa and a higher gray scale of data voltage HVdata is input to the lower sub pixel SPb.

Referring to FIG. 3, one sub pixel SP includes an upper sub pixel SPa and a lower sub pixel SPb. The upper sub pixel SPa and the lower sub pixel SPb are connected to one data line DL and are disposed to be adjacent to each other. The upper sub pixel SPa may be charged with the data voltage Vdata earlier than the lower sub pixel SPb. Gray scales displayed in each of the upper sub pixel SPa and the lower sub pixel SPb are composed to express 0 to 1023 grayscale levels.

Hereinafter, for the convenience of description, it is assumed that an upper sub pixel SPa is disposed in an n-th row and a lower sub pixel SPb is disposed in an n+1-th row.

Each of the upper sub pixel SPa of the n-th row and the lower sub pixel SPb of the n+1-th row is connected to a scan line SL, an emission control signal line EM, an initialization line, a data line DL, a high potential power line, and a low potential power line. Further, in each of the upper sub pixel SPa and the lower sub pixel SPb, a first transistor TR1, a second transistor TR2, a third transistor TR3, a fourth transistor TR4, a fifth transistor TR5, a sixth transistor TR6, a driving transistor DTR, a storage capacitor Cst, and a light emitting diode EL are disposed.

First, the driving transistor DTR of the upper sub pixel SPa of the n-th row includes a gate electrode, a source electrode, and a drain electrode. The gate electrode is connected to a second node N2, the source electrode is connected to a first node N1, and the drain electrode is connected to a third node N3. The driving transistor DTR may control a driving current flowing in the light emitting diode EL.

The first transistor TR1 includes a gate electrode, a source electrode, and a drain electrode. The gate electrode of the first transistor TR1 is connected to a scan line of an n-th row SL(n), the source electrode is connected to the second node N2, and the drain electrode is connected to the third node N3. The first transistor TR1 is turned on to connect the second node N2 and the third node N3.

The second transistor TR2 includes a gate electrode, a source electrode, and a drain electrode. The gate electrode of the second transistor TR2 is connected to a scan line of an n-th row SL(n), the source electrode is connected to the data line DL, and the drain electrode is connected to the first node N1. The second transistor TR2 transmits a data voltage Vdata from the data line DL to the first node N1 based on a scan signal of the scan line of the n-th row SL(n).

The third transistor TR3 includes a gate electrode, a source electrode, and a drain electrode. The gate electrode of the third transistor TR3 is connected to an emission control signal line of an n-th row EM(n), the source electrode is connected to the high potential power line, and the drain electrode is connected to the first node N1. The third transistor TR3 may transmit a high potential power voltage VDD to the first node N1 based on an emission control signal of the emission control signal line of the n-th row EM(n).

The fourth transistor TR4 includes a gate electrode, a source electrode, and a drain electrode. The gate electrode of the fourth transistor TR4 is connected to an emission control signal line of an n-th row EM(n), the source electrode is connected to the third node N3, and the drain electrode is connected to the fourth node N4. The fourth transistor TR4 may transmit a driving current from the driving transistor DTR to the light emitting diode EL based on the emission control signal of the emission control signal line of the n-th row EM(n).

The fifth transistor TR5 includes a gate electrode, a source electrode, and a drain electrode. The gate electrode of the fifth transistor TR5 is connected to a scan line of an n−2-th row SL(n−2), the source electrode is connected to the initialization line, and the drain electrode is connected to the second node N2. The fifth transistor TR5 may reset the second node N2 to an initialization voltage Vini from the initialization line based on the scan signal of the scan line of the n−2-th row SL(n−2).

The sixth transistor TR6 includes a gate electrode, a source electrode, and a drain electrode. The gate electrode of the sixth transistor TR6 is connected to a scan line of an n-th row SL(n), the source electrode is connected to the initialization line, and the drain electrode is connected to the fourth node N4. The sixth transistor TR6 may reset the fourth node N4 to an initialization voltage Vini from the initialization line based on the scan signal of the scan line of the n-th row SL(n).

The storage capacitor Cst includes a plurality of capacitor electrodes. Some of the plurality of capacitor electrodes is connected to the high potential power line and the other is connected to the second node N2. A data voltage Vdata in which the threshold voltage Vth of the driving transistor DTR is compensated is charged in the storage capacitor Cst to sample the data voltage Vdata and to compensate for a deviation of driving transistor DTR of each of the plurality of sub pixels SP.

The light emitting diode EL includes a first electrode and a second electrode. The first electrode of the light emitting diode EL is connected to the fourth node N4 and the second electrode is connected to the low potential power line to which a low potential power voltage VSS is supplied. The light emitting diode EL may emit light by a driving current from the driving transistor DTR.

Except that the lower sub pixel SPb of the n+1-th row is connected to the scan line of the n−1-th row SL(n−1), a scan line of the n+l-th row SL(n+1), and the emission control signal line of the n+1-th row EM(n+1), the other configurations thereof are substantially the same as the upper sub pixel SPa of the n-th row.

Specifically, gate electrodes of each of the first transistor TR1, the second transistor TR2, and the sixth transistor TR6 of the lower sub pixel SPb are connected to the scan line of the n+1-th row SL(n+1). The gate electrode of the fifth transistor TR5 is connected to the scan line of the n−1-th row SL(n−1) and the gate electrode of the fourth transistor TR4 is connected to the emission control signal line of the n+1-th row EM(n+1).

Referring to FIG. 4 together, a low level of scan signal is output to the scan line of the n−2-th row SL(n−2) at a first timing t1. The fifth transistor TR5 of the upper sub pixel SPa may be turned on by the scan signal of the scan line of the n−2-th row SL(n−2). The second node N2 and the gate electrode of the driving transistor DTR of the upper sub pixel SPa may be initialized to the initialization voltage Vini by the turned-on fifth transistor TR5.

Next, a low level of scan signal is output to the scan line of the n−1-th row SL(n−1) at a second timing t2. The fifth transistor TR5 of the lower sub pixel SPb may be turned on by the scan signal of the scan line of the n−1-th row SL(n−1). Accordingly, the second node N2 and the gate electrode of the driving transistor DTR of the lower sub pixel SPb may be initialized to the initialization voltage Vini from the second timing t2.

A low level of scan signal is output to the scan line of the n-th row SL(n) at a third timing t3. Therefore, the first transistor TR1, the second transistor TR2, and the sixth transistor TR6 of the upper sub pixel SPa connected to the scan line of the n-th row SL(n) may be turned on.

A low grayscale data voltage LVdata may be transmitted to the first node N1 of the upper sub pixel SPa from the data line DL by means of the turned-on second transistor TR2 at the third timing t3. At this time, the output low grayscale data voltage LVdata is a data voltage Vdata which is output to the upper sub pixel SPa in the digital to analog converter DAC as described with reference to FIG. 2B.

The gate electrode and the drain electrode of the driving transistor DTR are shorted by the turned-on first transistor TR1 to form diode-connection. At this time, the low grayscale data voltage LVdata transmitted through the second transistor TR2 is transmitted to the driving transistor DTR so that the voltage of the second node N2 may be changed to a sum of the low grayscale data voltage LVdata and the threshold voltage Vth from the initialization voltage Vini. That is, the low grayscale data voltage LVdata is charged in the upper sub pixel SPa and then the upper sub pixel SPa may emit light with a gray scale corresponding to the low grayscale data voltage LVdata.

The voltage of the fourth node N4 may be reset to the initialization voltage Vini from the initialization line by means of the turned-on sixth transistor TR6.

Next, a low level of scan signal is output to the scan line of the n+1-th row SL(n+1) at a fourth timing t4 so that the first transistor TR1, the second transistor TR2, and the sixth transistor TR6 of the lower sub pixel SPb may be turned on.

A low grayscale data voltage LVdata may be transmitted to the first node N1 of the lower sub pixel SPb from the data line DL by means of the turned-on second transistor TR2. At this time, the output low grayscale data voltage LVdata is a voltage corresponding to a gray scale to be displayed in the upper sub pixel SPa. That is, the low grayscale data voltage LVdata charged in the upper sub pixel SPa may also be charged in the lower sub pixel SPb from the fourth timing t4 to a fifth timing t5.

A high grayscale data voltage HVdata corresponding to a gray scale to be displayed in the lower sub pixel SPb is output from the digital to analog converter DAC from the fifth timing t5. At this time, even though the high grayscale data voltage HVdata is output to the data line DL, from the fifth timing t5, the scan signal of the scan line of the n-th row SL(n) becomes a high level so that the second transistor TR2 of the upper sub pixel SPa is turned off and then the high grayscale data voltage HVdata is not transmitted to the upper sub pixel SPa.

A high grayscale data voltage HVdata corresponding to the gray scale to be displayed in the lower sub pixel SPb starts to be charged only in the lower sub pixel SPb after the fifth timing t5. From the fourth timing t4 to the fifth timing t5, the same low grayscale data voltage LVdata is charged in the gate electrode of the driving transistor DTR of each of the lower sub pixel SPb and the high sub pixel SPa. From the fifth timing t5, the high grayscale data voltage HVdata may be charged only in the gate electrode of the driving transistor DTR of the lower sub pixel SPb.

In summary, from the third timing t3 to the fifth timing t5, the low grayscale data voltage LVdata is charged in the upper sub pixel SPa and the lower sub pixel SPb. Further, from the fifth timing to a sixth timing t6, overlap-driving in which the high grayscale data voltage HVdata is charged may be performed in the lower sub pixel SPb. The voltage of the gate electrode of the driving transistor DTR of the lower sub pixel SPb may be increased from the sum of the low gray scale data voltage LVdata and the threshold voltage Vth to a sum of the high gray scale data voltage HVdata and the threshold voltage Vth from the fifth timing t5 to the sixth timing t6.

Next, when charging of the low grayscale data voltage LVdata in the upper sub pixel SPa and the high grayscale data voltage HVdata in the lower sub pixel SPb is completed, the emission control signal is output to each of the upper sub pixel SPa and the lower sub pixel SPb to allow the light emitting diode EL to emit light.

Specifically, a low level of emission control signal is output to the emission control signal line of the n-th row EM(n) at a seventh timing t7. The fourth transistor TR4 of the upper sub pixel SPa may be turned on by the emission control signal and the driving current may flow to the light emitting diode EL by means of the turned-on fourth transistor TR4. Accordingly, in the upper sub pixel SPa, the light emitting diode EL emits light from the seventh timing t7 so that a gray scale corresponding to the low grayscale data voltage LVdata may be expressed.

Next, a low level of emission control signal is output to the emission control signal line of the n+1-th row EM(n+1) at an eighth timing t8. The fourth transistor TR4 of the lower sub pixel SPb is turned on by the emission control signal to transmit a driving current to the light emitting diode EL. Accordingly, in the lower sub pixel SPb, the light emitting diode EL emits light from the eighth timing t8 so that a gray scale corresponding to the high grayscale data voltage HVdata may be expressed.

In the meantime, in the display device 100 according to an example embodiment of the present disclosure, when two different gray scales are composed, the upper sub pixel SPa is charged with the low grayscale data voltage LVdata and the low sub pixel SPb is charged with the high grayscale data voltage HVdata. In the upper sub pixel SPa and the lower sub pixel SPb which share one data line DL, the data voltage (Vdata) charging time may partially overlap by the overlap-driving. When the high grayscale data voltage HVdata is charged in the upper sub pixel SPa in which the data voltage Vdata is charged earlier, it is difficult to charge the low grayscale data voltage LVdata in the lower sub pixel SPb in which the data voltage Vdata is charged later. Therefore, in the display device 100 according to an example embodiment of the present disclosure, the low grayscale data voltage LVdata is charged in the upper sub pixel SPa in which the data voltage Vdata is charged earlier and the high grayscale data voltage HVdata is charged in the lower sub pixel SPb which is charged later. By doing this, the data voltage Vdata may be normally charged in both the upper sub pixel SPa and the lower sub pixel SPb, which will be described in more detail with reference to FIGS. 5A and 5B.

Figure 5A:
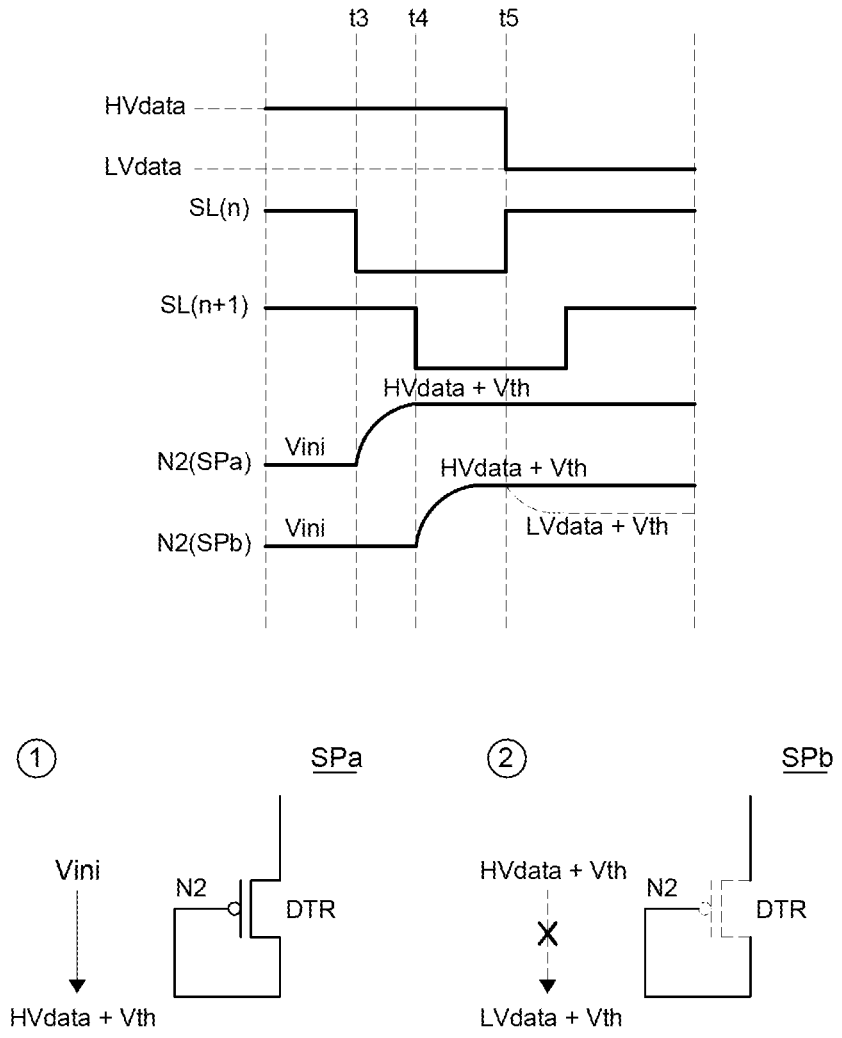
FIGS. 5A and 5B are views for explaining a process of inputting a data voltage to an upper sub pixel and a lower sub pixel of a display device according to an example embodiment of the present disclosure.
Figure 5B:
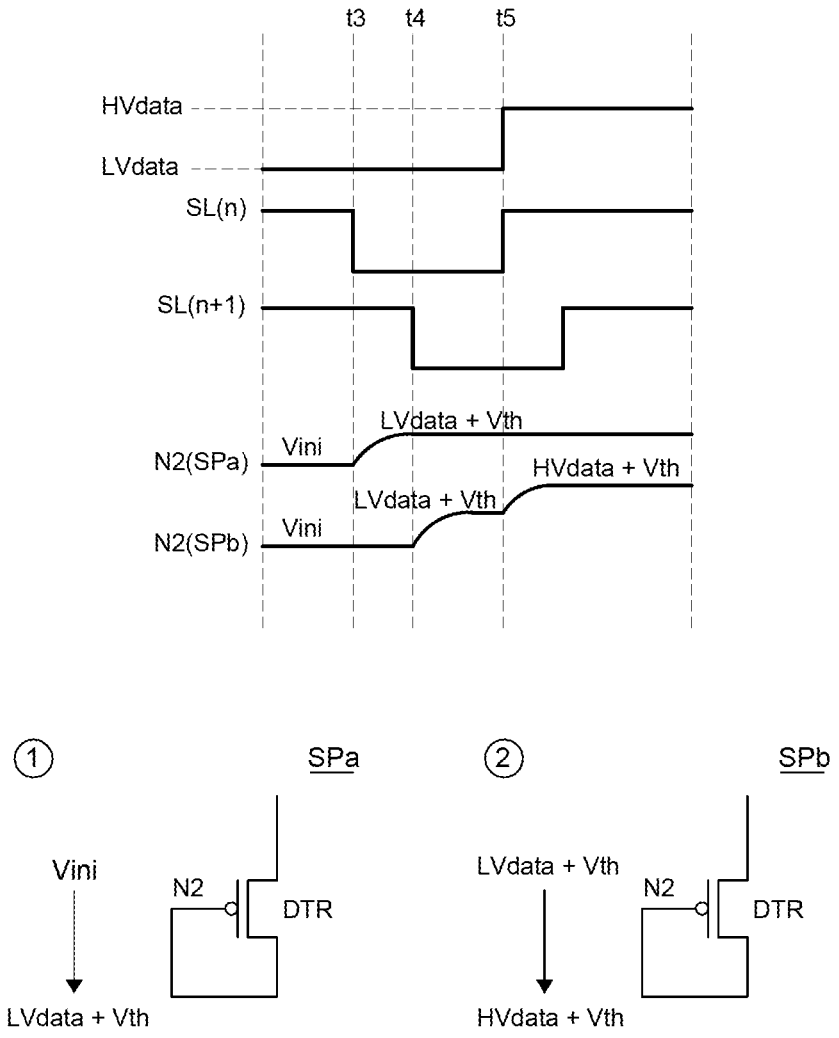

FIGS. 5A and 5B are views for explaining a process of inputting a data voltage to an upper sub pixel and a lower sub pixel of a display device according to an example embodiment of the present disclosure. FIG. 5A is a view for explaining a process of inputting a high grayscale data voltage HVdata to an upper sub pixel SPa and inputting a low grayscale data voltage LVdata to a lower sub pixel SPb. FIG. 5B is a view for explaining a process of inputting a low grayscale data voltage LVdata to an upper sub pixel SPa and inputting a high grayscale data voltage HVdata to a lower sub pixel SPb.

Referring to FIGS. 3, 4, and 5A together, at the timing t3, the first transistor TR1 of the upper sub pixel SPa is turned on by the scan signal of the scan line of the n-th row SL(n). In the driving transistor DTR of the upper sub pixel SPa, the gate electrode and the drain electrode may be in a connected state by the turned-on first transistor TR1.

When the high grayscale data voltage HVdata is applied to the upper sub pixel SPa, the voltage of the gate electrode of the driving transistor DTR may be increased from the initialization voltage Vini to the sum of the high gray scale data voltage HVdata and the threshold voltage Vth. The high grayscale data voltage HVdata may be charged until a difference of a voltage Vgs between the gate electrode and the source electrode of the driving transistor DTR and the threshold voltage Vth of the driving transistor DTR becomes 0. That is, until the voltage of the gate electrode of the driving transistor DTR becomes a sum of the high grayscale data voltage HVdata and the threshold voltage Vth, the high grayscale data voltage HVdata may be charged.

Next, at the fourth timing t4, the first transistor TR1 of the lower sub pixel SPb is turned on by the scan signal of the scan line of the n+1-th row SL(n+1) and the gate electrode and the drain electrode of the driving transistor DTR are connected by the first transistor TR1 to be in a diode-connection state serving as a diode.

At this time, at the fourth timing t4, the high grayscale data voltage HVdata may also be applied to the lower sub pixel SPb. From the fourth timing t4 to the fifth timing t5, the high grayscale data voltage HVdata is applied to the lower sub pixel SPb, so that the voltage of the gate electrode of the driving transistor DTR may be increased from the initialization voltage Vini to the sum of the high grayscale data voltage HVdata and the threshold voltage Vth.

Next, from the fifth timing t5, the low grayscale data voltage LVdata may be applied to the lower sub pixel SPb. Only when the voltage of the gate electrode of the driving transistor DTR becomes a sum of the low grayscale data voltage LVdata and the threshold voltage Vth from the sum of the high grayscale data voltage HVdata and the threshold voltage Vth, the lower sub pixel SPb may express a gray scale corresponding to the low grayscale data voltage LVdata.

However, the voltage of the gate electrode of the driving transistor DTR is already charged with the sum of the high grayscale data voltage HVdata and the threshold voltage Vth. Therefore, when the low grayscale data voltage LVdata is applied to the source electrode of the driving transistor DTR, the difference of the voltage Vgs between the gate electrode and the source electrode and the threshold voltage Vth may be higher than 0. In this case, the driving transistor DTR of the lower sub pixel SPb is turned off so that the data voltage Vdata in which the threshold voltage Vth of the driving transistor DTR is compensated is not appropriately charged in the storage capacitor Cst, and the deviation of the lower sub pixel SPb may not be normally compensated.

Therefore, when the high grayscale data voltage HVdata is supplied to the upper sub pixel SPa and the lower sub pixel SPb first, and after a predetermined or selected time, the low grayscale data voltage LVdata is supplied to the lower sub pixel SPb, the driving transistor DTR of the lower sub pixel SPb is turned off. By doing this, the deviation of the threshold voltage Vth may not be compensated and the low grayscale data voltage LVdata may not be normally input to the lower sub pixel SPb.

In contrast, referring to FIG. 5B, the display device 100 according to an example embodiment of the present disclosure charges the upper sub pixel SPa and the lower sub pixel SPb with the low grayscale data voltage LVdata. In this case, the voltage of the gate electrode of the driving transistor DTR of each of the upper sub pixel SPa and the lower sub pixel SPb may be changed from the initialization voltage Vini to the sum of the low grayscale data voltage LVdata and the threshold voltage Vth.

Next, from the fifth timing t5, the high grayscale data voltage HVdata is supplied to the lower sub pixel SPb. The voltage of the gate electrode of the driving transistor DTR of the lower sub pixel SPb may be changed from the sum of the low grayscale data voltage LVdata and the threshold voltage Vth to a sum of the high grayscale data voltage HVdata and the threshold voltage Vth. In this case, the high grayscale data voltage HVdata is input to the source electrode of the driving transistor DTR so that a difference of the voltage Vgs between the gate electrode and the source electrode of the driving transistor DTR and the threshold voltage Vth is smaller than 0. Accordingly, when the high grayscale data voltage HVdata is input, the driving transistor DTR may be continuously maintained to be turned on.

Therefore, the driving transistor DTR of the lower sub pixel SPb may maintain a turn-on state until the voltage of the gate electrode becomes a sum of the high grayscale data voltage HVdata and the threshold voltage Vth. The data voltage Vdata in which the threshold voltage Vth is compensated may be normally charged in the storage capacitor Cst.

Accordingly, when the low grayscale data voltage LVdata is input to the upper sub pixel SPa and the high grayscale data voltage HVdata is input to the lower sub pixel SPb, the overlap-driving of the upper sub pixel SPa and the lower sub pixel SPb is possible and the internal compensation of the upper sub pixel SPa and the lower sub pixel SPb may be normally performed.

Accordingly, the display device 100 according to an example embodiment of the present disclosure composes the gray scale displayed in each of the upper sub pixel SPa and the lower sub pixel SPb to express grayscale levels more than the levels expressible with the number bits which can be converted in the digital to analog converter DAC. Specifically, when the digital to analog converter DAC which can convert the 9-bit image data RGB is used, only 0 to 511 grayscale levels may be displayed. However, each of 0 to 511 levels of 9 bits may be set to correspond to even-numbered grayscale levels or odd-numbered grayscale levels among 0 to 1023 grayscale levels of 10-bit image data RGB. If the even-numbered grayscale levels, among 0 to 1023 grayscale levels, match each of 0 to 511 levels of 9 bits, the 9-bit signal is converted into the data voltage Vdata as it is and then output to the sub pixel SP to display the even-numbered grayscale levels. When the odd-numbered grayscale levels are displayed, an even-numbered grayscale level lower than the odd-numbered grayscale level is displayed in the upper sub pixel SPa and an even-numbered grayscale level higher than the odd-numbered grayscale level may be displayed in the lower sub pixel SPb. Accordingly, gray scales of the upper sub pixel SPa and the lower sub pixel SPb are composed to display odd-numbered grayscale levels. Accordingly, in the display device 100 according to an example embodiment of the present disclosure, even though the digital to analog converter DAC which can convert the 9-bit digital signal is used, the gray scales of the upper sub pixel SPa and the lower sub pixel SPb are composed to easily display the 10-bit image data RGB.

In the display device 100 according to an example embodiment of the present disclosure, the overlap-driving of the upper sub pixel SPa and the lower sub pixel SPb allows the gray scales to be composed and the driving time of each of the sub pixel SP to be ensured. In order to display an intermediate gray scale by composing the even-numbered grayscale level and the odd-numbered grayscale level, one sub pixel SP may be configured by the upper sub pixel SPa and the lower sub pixel SPb. In this case, the number of sub pixels SP connected to one data line DL is doubled, but the driving time given to one sub pixel SP is inevitably reduced. Accordingly, a time beneficial to internally compensate for the deviation of each sub pixel SP may be ensured by overlap-driving of the upper sub pixel SPa and the lower sub pixel SPb. During the overlap-driving, a period in which the data voltage Vdata is input to the upper sub pixel SPa may partially overlap a period in which the data voltage Vdata is input to the lower sub pixel SPb. Therefore, in the display device 100 according to an example embodiment of the present disclosure, the upper sub pixel SPa and the lower sub pixel SPb are overlap-driven to ensure a driving time beneficial to input the signal to each of a plurality of sub pixels SP and to compensate for the deviation.

In the display device 100 according to an example embodiment of the present disclosure, when different gray scales are composed, the low grayscale data voltage LVdata is input to the upper sub pixel SPa and the high grayscale data voltage HVdata is input to the lower sub pixel SPb of one sub pixel SP. By doing this, one sub pixel SP may be internally compensated. First, the period of the upper sub pixel SPa and the lower sub pixel SPb in which the data voltage Vdata is input partially overlaps. For example, from the timing t4 to the timing t5, the lower gray scale data voltage LVdata is input to both the upper sub pixel SPa and the lower sub pixel SPb. From the timing t5, the high grayscale data voltage HVdata is input only to the lower sub pixel SPb. At this time, when the high grayscale data voltage HVdata is input to the upper sub pixel SPa first, the voltage of the gate electrode of the driving transistor DTR of each of the upper sub pixel SPa and the lower sub pixel SPb may be charged with a sum of the high grayscale data voltage HVdata and the threshold voltage Vth. When the low grayscale data voltage LVdata is input to the lower sub pixel SPb, a difference of the voltage Vgs between the gate electrode and the source electrode of the driving transistor DTR of the lower sub pixel SPb and the threshold voltage Vth is larger than 0 so that the driving transistor DTR may be turned off. Therefore, the data voltage Vdata in which the threshold voltage Vth is compensated may not be normally charged in the storage capacitor Cst. Accordingly, in the display device 100 according to an example embodiment of the present disclosure, the low grayscale data voltage LVdata is charged in the upper sub pixel SPa and the high grayscale data voltage HVdata is charged in the lower sub pixel SPb. As a result, both the upper sub pixel SPa and the lower sub pixel SPb may be normally driven.

Figure 6:
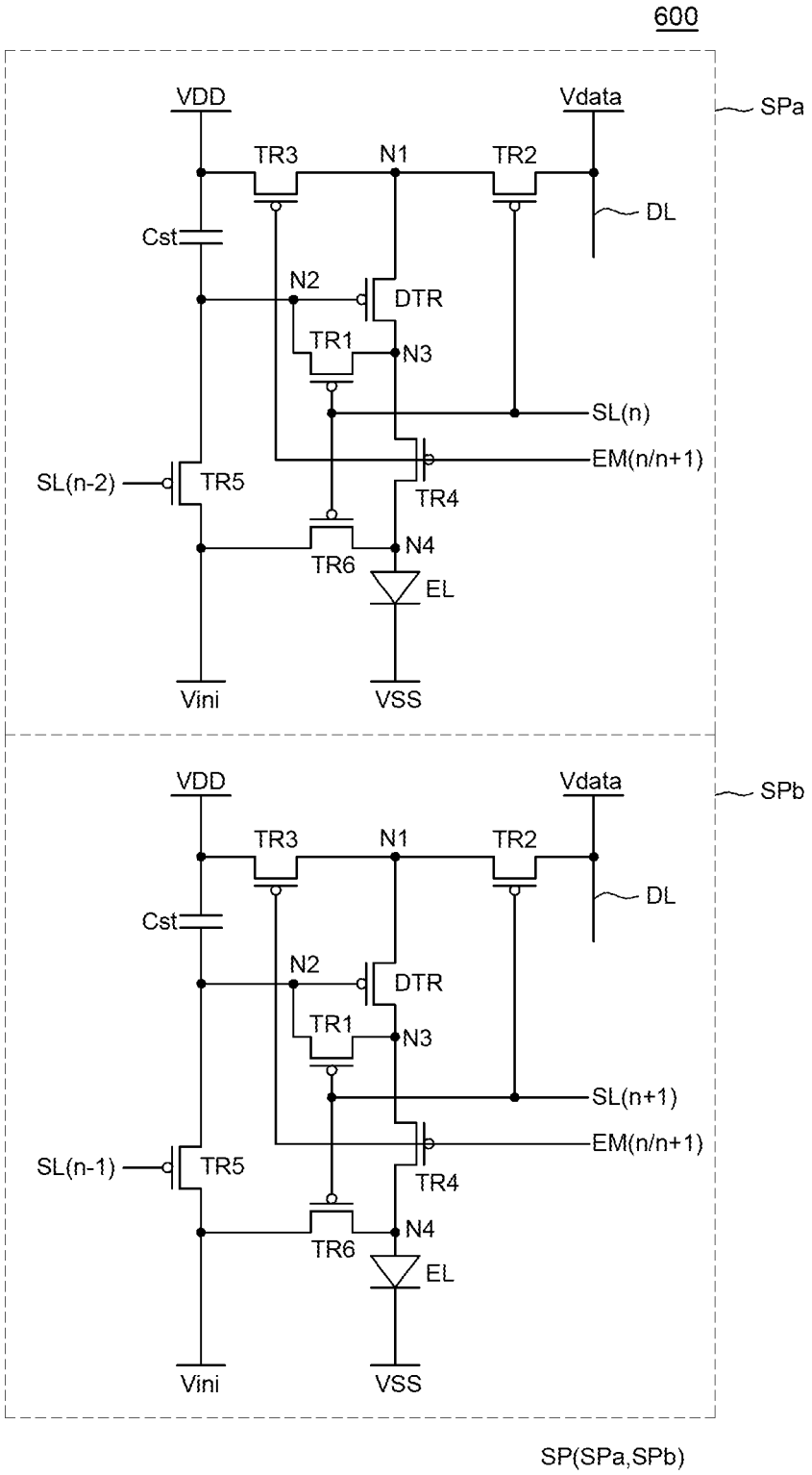
FIG. 6 is a circuit diagram of an upper sub pixel and a lower sub pixel of a display device according to another example embodiment of the present disclosure.
Figure 7:
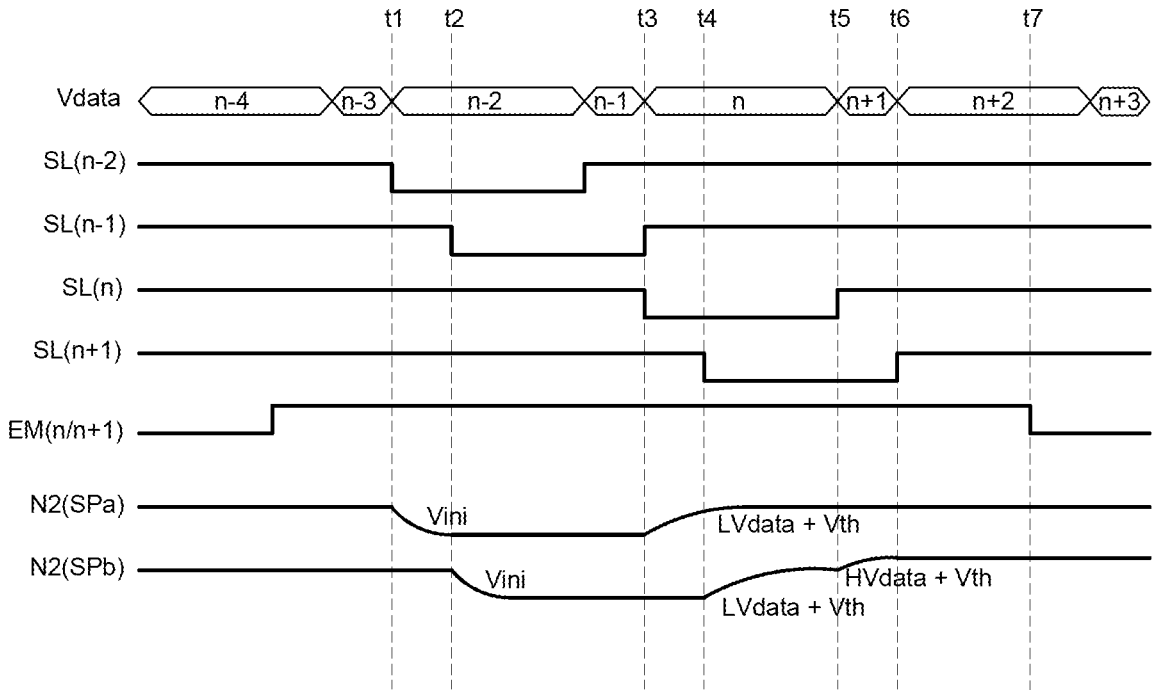
FIG. 7 is a driving timing diagram of an upper sub pixel and a lower sub pixel of a display device according to another example embodiment of the present disclosure.
Figure 8A:
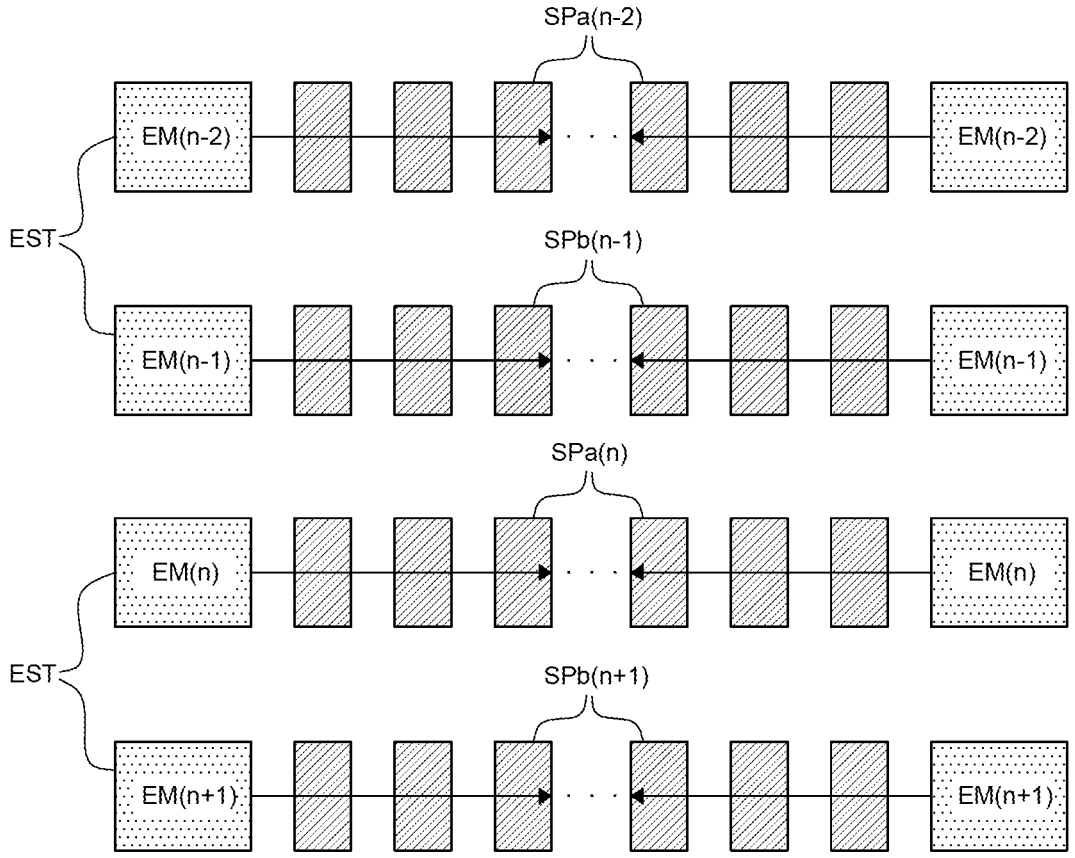
FIG. 8A is a view for explaining a case in which an upper sub pixel and a lower sub pixel are connected to different emission control signal lines.
Figure 8B:
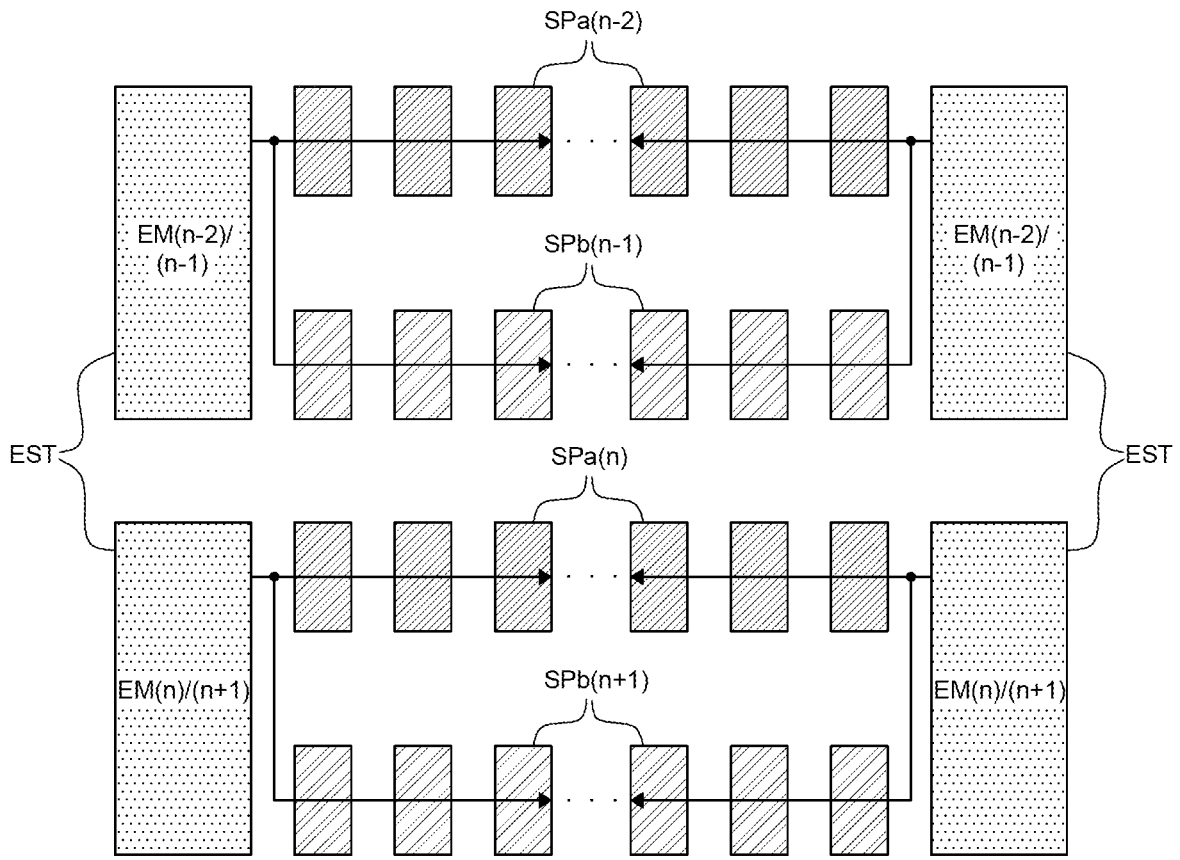
FIG. 8B is a view for explaining a case in which an upper sub pixel and a lower sub pixel are connected to the same emission control signal line.

FIG. 6 is a circuit diagram of an upper sub pixel and a lower sub pixel of a display device according to another example embodiment of the present disclosure. FIG. 7 is a driving timing diagram of an upper sub pixel and a lower sub pixel of a display device according to another example embodiment of the present disclosure. FIG. 8A is a view for explaining a case in which an upper sub pixel and a lower sub pixel are connected to different emission control signal lines. FIG. 8B is a view for explaining a case in which an upper sub pixel and a lower sub pixel are connected to the same emission control signal line. The only difference between a display device 600 of FIGS. 6 and 7 and the display device 100 of FIGS. 1 to 4 is an emission control signal line EM(n/n+1), but the other configurations are substantially the same, so that a redundant description will be omitted.

Referring to FIG. 6, the upper sub pixel SPa and the lower sub pixel SPb are connected to the same common emission control signal line EM(n/n+1). Each of the fourth transistor TR4 of the upper sub pixel SPa and the fourth transistor TR4 of the lower sub pixel SPb may be simultaneously turned on based on the emission control signal from the common emission control signal line EM(n/n+1). The upper sub pixel SPa and the lower sub pixel SPb are connected to the common emission control signal line EM(n/n+1) to simultaneously emit light.

Referring to FIG. 7, at the seventh timing t7, a low level of emission control signal is applied to the common emission control signal line EM(n/n+1). In this case, both the light emitting diodes EL of the upper sub pixel SPa and the lower sub pixel SPb may emit light from the seventh timing t7. Accordingly, the upper sub pixel SPa and the lower sub pixel SPb may simultaneously emit light by sharing one common emission control signal line EM(n/n+1).

Therefore, in the display device 600 according to another example embodiment of the present disclosure, the upper sub pixel SPa and the lower sub pixel SPb share one common emission control signal line EM(n/n+1) to simplify the structure of the display device 600.

Specifically, referring to FIGS. 8A and 8B, the emission control signal which is output to the emission control line may be generated from the emission control driver EST connected to each of the emission control signal lines. Each of the plurality of emission control driver EST may be formed of a plurality of transistors and a storage capacitor to sequentially output the emission control signals. However, as the number of the plurality of emission control drivers EST is increased, the structure of the display device 600 becomes complex and the bezel area may be increased.

For example, referring to FIG. 8A, each of the upper sub pixel SPa and the lower sub pixel SPb may be connected to different emission control drivers EST. Upper sub pixels SPa in an n−2-th row are connected to an emission control driver EST in the n−2-th row. Lower sub pixels SPb in an n−1-th row may be connected to an emission control driver EST in the n−1-th row. Upper sub pixels SPa in an n-th row are connected to an emission control driver EST in the n-th row. Lower sub pixels SPb in an n+1-th row may be connected to an emission control driver EST in the n+1-th row. In summary, the emission control driver EST is disposed so as to correspond to each of the n−2-th row, the n−1-th row, the n-th row, and the n+1-th row to drive a plurality of sub pixels SP.

In contrast, referring to FIG. 8B, in the display device 600 according to another example embodiment of the present disclosure, the upper sub pixel SPa and the lower sub pixel SPb may be connected to one emission control driver EST. The upper sub pixels SPa in the n−2-th row and the lower sub pixels SPb in the n−1-th row are connected to one emission control driver EST. The upper sub pixels SPa in the n-th row and the lower sub pixels SPb in the n+1-th row are connected to one emission control driver EST. In this case, the upper sub pixel SPa and the lower sub pixel SPb which are adjacent to each other share the emission control driver EST so that the number of emission control drivers EST is reduced and the structure of the display device 600 may be simplified.

Accordingly, in the display device 600 according to another example embodiment of the present disclosure, one pair of the upper sub pixel SPa and the lower sub pixel SPb shares one common emission control signal line EM(n/n+1) so that the number of emission control signal lines may be reduced by half. Further, the number of emission control drivers EST connected to each of the emission control signal lines is also simplified. As a result, in the display device 600 according to another example embodiment of the present disclosure, the upper sub pixel SPa and the lower sub pixel SPb share one common emission control signal line EM(n/n+1) to remove a part of the configurations such as the emission control driver EST and to simplify the structure of the display device 600.

Figure 9:
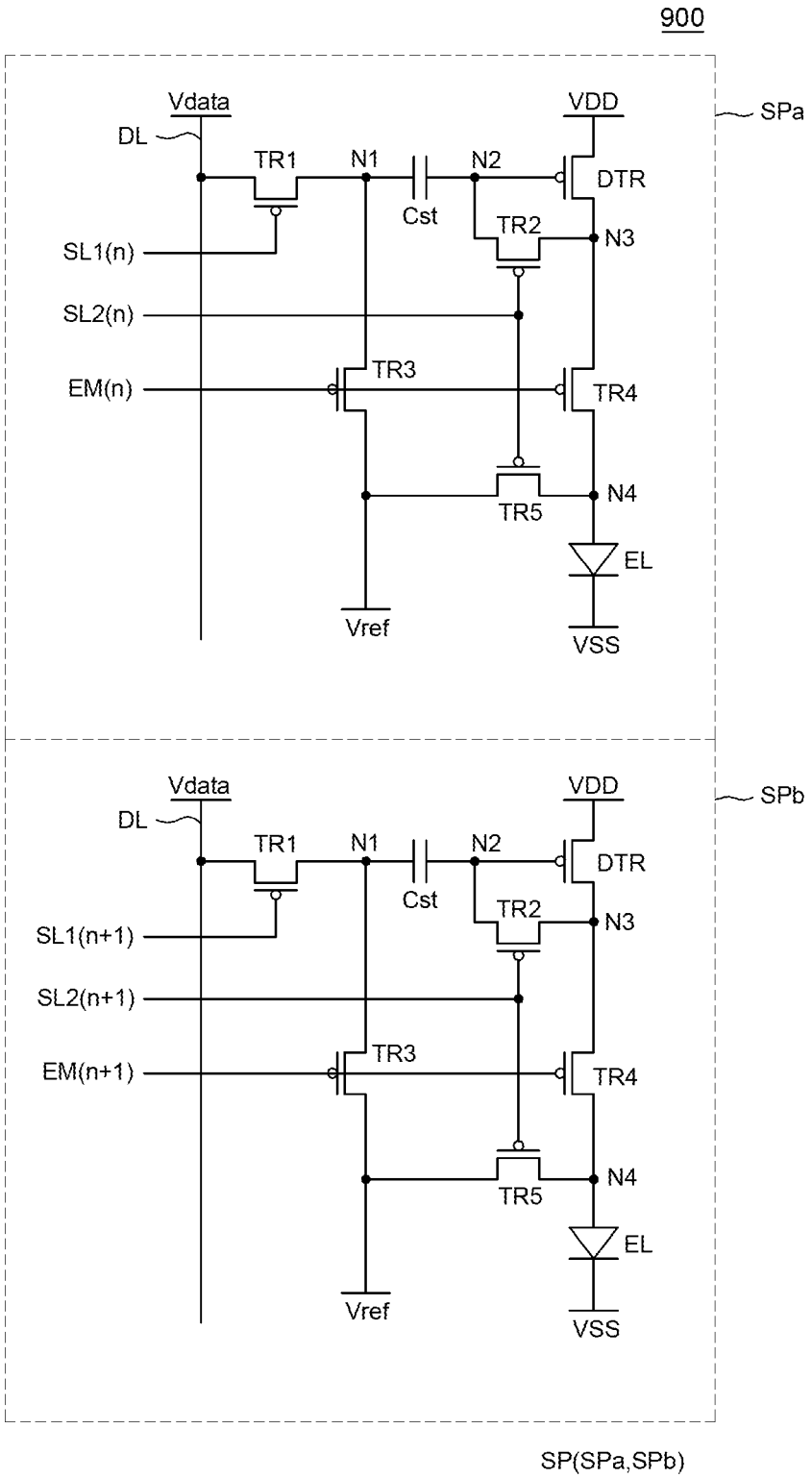
FIG. 9 is a circuit diagram of an upper sub pixel and a lower sub pixel of a display device according to still another example embodiment of the present disclosure.
Figure 11A:
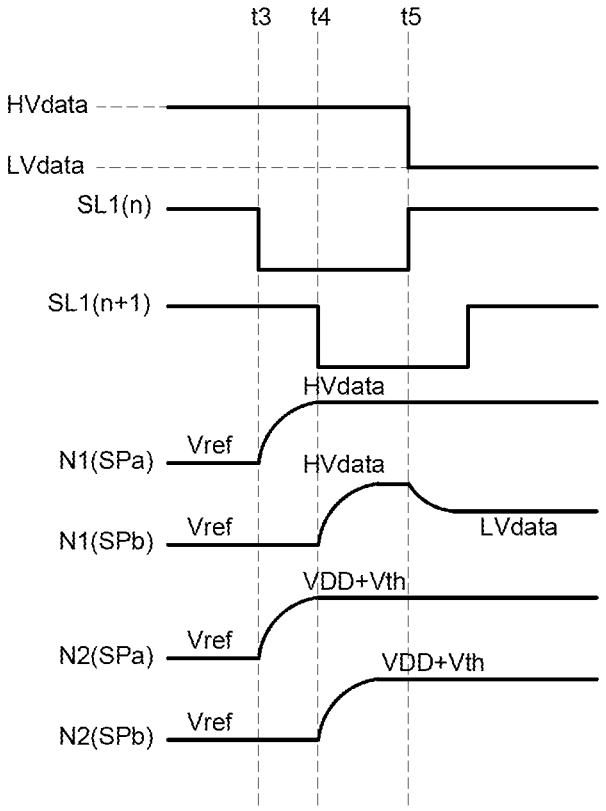
FIGS. 11A and 11B are views for explaining a process of inputting a data voltage to an upper sub pixel and a lower sub pixel of a display device according to still another example embodiment of the present disclosure.
Figure 11A:
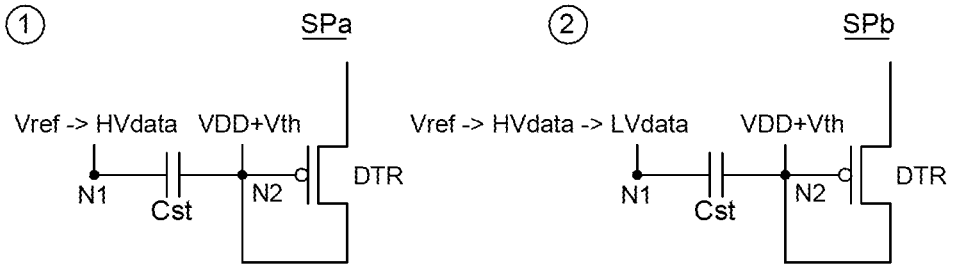
Figure 11B:
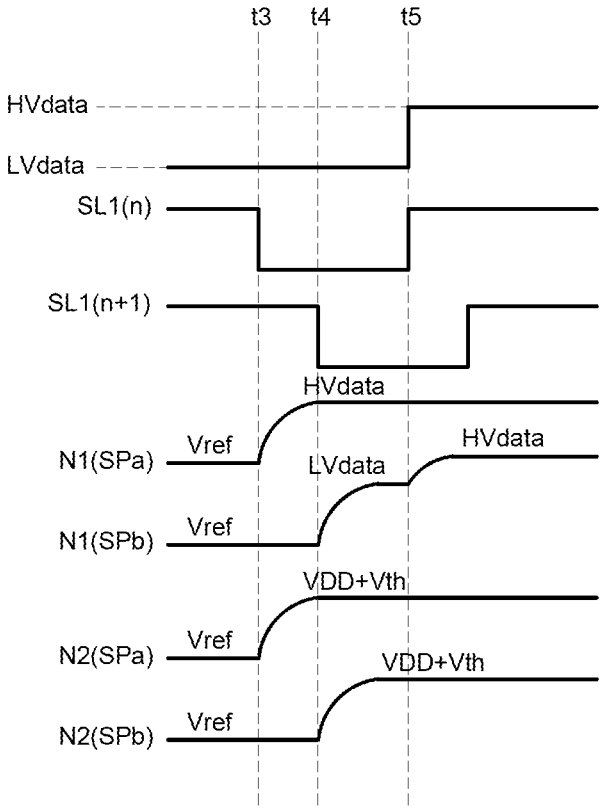
Figure 11B:
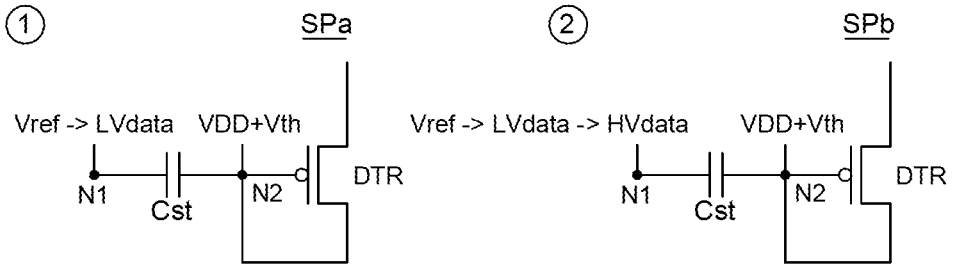

FIG. 9 is a circuit diagram of an upper sub pixel and a lower sub pixel of a display device according to still another example embodiment of the present disclosure. FIG. 10 is a driving timing diagram of an upper sub pixel and a lower sub pixel of a display device according to still another example embodiment of the present disclosure. FIGS. 11A and 11B are views for explaining a process of inputting a data voltage to an upper sub pixel and a lower sub pixel of the display device according to still another example embodiment of the present disclosure. FIG. 10 is a timing diagram when a low grayscale data voltage LVdata is input to an upper sub pixel SPa and a high grayscale data voltage HVdata is input to a lower sub pixel SPb, as illustrated in FIG. 2B. FIG. 11A is a view for explaining a process of inputting a high grayscale data voltage HVdata to an upper sub pixel SPa and inputting a low grayscale data voltage LVdata to a lower sub pixel SPb. FIG. 11B is a view for explaining a process of inputting a low grayscale data voltage LVdata to an upper sub pixel SPa and inputting a high grayscale data voltage HVdata to a lower sub pixel SPb. The only difference between a display device 900 of FIGS. 9 and 10 and the display device 100 of FIGS. 1 to 4 is a circuit of each sub pixel SP, but other configurations are substantially the same, so that a redundant description will be omitted.

Referring to FIG. 9, one sub pixel SP includes an upper sub pixel SPa and a lower sub pixel SPb. The upper sub pixel SPa and the lower sub pixel SPb are connected to one data line DL and are disposed to be adjacent to each other. The upper sub pixel SPa may be charged with the data voltage Vdata earlier than the lower sub pixel SPb. Gray scales displayed in each of the upper sub pixel SPa and the lower sub pixel SPb are composed to express 0 to 1023 grayscale levels.

Hereinafter, for the convenience of description, it is assumed that the upper sub pixel SPa is disposed in an n-th row and the lower sub pixel SPb is disposed in an n+1-th row.

Each of the upper sub pixel SPa of the n-th row and the lower sub pixel SPb of the n+1-th row is connected to a scan line SL, an emission control signal line, a reference line, a data line DL, a high potential power line, and a low potential power line. Further, in each of one pair of the upper sub pixel SPa and the lower sub pixel SPb, a first transistor TR1, a second transistor TR2, a third transistor TR3, a fourth transistor TR4, a fifth transistor TR5, a driving transistor DTR, a storage capacitor Cst, and a light emitting diode EL are disposed.

The driving transistor DTR of the upper sub pixel SPa of the n-th row includes a gate electrode, a source electrode, and a drain electrode. The gate electrode is connected to a second node N2, the source electrode is connected to the high potential power line, and the drain electrode is connected to a third node N3. The driving transistor DTR may control a driving current flowing in the light emitting diode EL.

The first transistor TR1 includes a gate electrode, a source electrode, and a drain electrode. The gate electrode of the first transistor TR1 is connected to a first scan line of an n-th row SL1(*n*), the source electrode is connected to the data line DL, and the drain electrode is connected to the first node N1. The first transistor TR1 may transmit a data voltage Vdata from the data line DL to the first node N1 based on a scan signal of the first scan line of the n-th row SL1(*n*).

The second transistor TR2 includes a gate electrode, a source electrode, and a drain electrode. The gate electrode of the second transistor TR2 is connected to a second scan line of an n-th row SL2(*n*), the source electrode is connected to the second node N2, and the drain electrode is connected to the third node N3. The second transistor TR2 is turned on to connect between the gate electrode and the drain electrode of the driving transistor DTR, that is, the second node N2 and the third node N3.

The third transistor TR3 includes a gate electrode, a source electrode, and a drain electrode. The gate electrode of the third transistor TR3 is connected to an emission control signal line of an n-th row EM(n), and the source electrode and the drain electrode are connected between the first node N1 and the reference line. The third transistor TR3 is turned on by the emission control signal to supply a reference voltage Vref to the first node N1.

The fourth transistor T4 includes a gate electrode, a source electrode, and a drain electrode. The gate electrode of the fourth transistor TR4 is connected to an emission control signal line of an n-th row EM(n), the source electrode is connected to the third node N3, and the drain electrode is connected to the fourth node N4. The fourth transistor T4 is turned on by the emission control signal to transmit a driving current from the driving transistor DTR to the light emitting diode EL.

The fifth transistor TR5 includes a gate electrode, a source electrode, and a drain electrode. The gate electrode of the fifth transistor TR5 is connected to a second scan line of an n-th row SL2(*n*), and the source electrode and the drain electrode are connected between the reference line and the fourth node N4. The fifth transistor TR5 may transmit the reference voltage Vref to the fourth node N4 based on the scan signal of the second scan line of the n-th row SL2(*n*).

The storage capacitor Cst includes a plurality of capacitor electrodes connected to each of the first node N1 and the second node N2. The storage capacitor Cst may constantly maintain the data voltage Vdata supplied through the first transistor TR1 for one frame. The storage capacitor Cst may constantly maintain a voltage Vgs between the gate electrode and the source electrode of the driving transistor DTR.

The light emitting diode EL includes a first electrode and a second electrode. The first electrode of the light emitting diode EL is connected to the fourth node N4 and the second electrode is connected to a low potential power voltage VSS. The light emitting diode EL may emit light by a driving current from the driving transistor DTR.

Except that the lower sub pixel SPb is connected to the first scan line of the n+1-th row SL1(*n*+1), the second scan line of the n+1-th row SL2(*n*+1), and the emission control signal line of the n+1-th row EM(n+1), the other configurations thereof are substantially the same as those of the upper sub pixel SPa.

Specifically, the gate electrode of the first transistor TR1 of the lower sub pixel SPb is connected to the first scan line of the n+1-th row SL1(*n*+1) and the gate electrodes of the second transistor TR2 and the fifth transistor TR5 are connected to the second scan line of the n+1-th row SL2 (*n*+1). Further, the gate electrodes of the third transistor TR3 and the fourth transistor TR4 are connected to the emission control signal line of the n+1-th row EM(n+1).

Referring to FIG. 9 together, the upper sub pixel SPa and the lower sub pixel SPb may be overlap driven. During the overlap-driving, a period in which the data voltage Vdata is supplied to the upper sub pixel SPa may partially overlap a period in which the data voltage Vdata is supplied to the lower sub pixel SPb.

First, at a first timing t1, a low level of scan signal is output to the second scan line of the n-th row SL2(*n*). The second transistor TR2 and the fifth transistor TR5 of the upper sub pixel SPa may be turned on by the scan signal of the second scan line of the n-th row SL2(*n*). The fourth node N4 of the upper sub pixel SPa may be initialized to the reference voltage Vref by the turned-on fifth transistor TR5. The second node N2 and the third node N3 of the upper sub pixel SPa may be connected by the turned-on second transistor TR2.

Next, a low level of scan signal is output to the second scan line of the n+1-th row SL2(*n*+1) at a second timing t2. The second transistor TR2 and the fifth transistor TR5 of the lower sub pixel SPb may be turned on by the scan signal of the second scan line of the n+1-th row SL2(*n*+1). The fourth node N4 of the lower sub pixel SPb may be initialized to the reference voltage Vref by the turned-on fifth transistor TR5. The second node N2 and the third node N3 of the lower sub pixel SPb may be connected by the turned-on second transistor TR2.

At a third timing t3, a low level of scan signal is output to the first scan line of the n-th row SL1(*n*) and a high level of emission control signal is output to the emission control signal line of the n-th row EM(n). A low grayscale data voltage LVdata or a high grayscale data voltage HVdata is output to the data line DL. The first transistor TR1 of the upper sub pixel SPa is turned on by the scan signal of the first scan line of the n-th row SL1(*n*). The third transistor TR3 and the fourth transistor TR4 of the upper sub pixel SPa are turned off by the emission control signal of the emission control signal line of the n-th row EM(n). The first transistor TR1 is turned on to transmit the low grayscale data voltage LVdata or the high grayscale data voltage HVdata from the data line DL to the first node N1 of the upper sub pixel SPa. Accordingly, the low grayscale data voltage LVdata or the high grayscale data voltage HVdata may be charged in the upper sub pixel SPa and when the light emitting diode EL emits light, the upper sub pixel SPa may express a low gray scale.

At a fourth timing t4, a low level of scan signal is output to the first scan line of the n+1-th row SL1(*n*+1) and a high level of emission control signal is output to the emission control signal line of the n+1-th row EM(n+1). The first transistor TR1 of the lower sub pixel SPb is turned on by the scan signal of the first scan line of the n+1-th row SL1(*n*+1). The third transistor TR3 and the fourth transistor TR4 of the lower sub pixel SPb are turned off by the emission control signal of the emission control signal line of the n+1-th row EM(n+1). The first transistor TR1 is turned on from the fourth timing t4 to transmit the low grayscale data voltage LVdata or the high grayscale data voltage HVdata from the data line DL to the first node N1 of the lower sub pixel SPb.

From the third timing t3 to a fifth timing t5, any one of the low grayscale data voltage LVdata and the high grayscale data voltage HVdata is output to the data line DL. From the fifth timing t5 to a sixth timing t6, the other one of the low grayscale data voltage LVdata and the high grayscale data voltage HVdata is output to the data line DL. Therefore, from the timing t5, the first transistor TR1 may transmit the low grayscale data voltage LVdata or the high grayscale data voltage HVdata from the data line DL to the first node N1 of the lower sub pixel SPb.

In summary, from the third timing t3 to the fifth timing t5, the low grayscale data voltage LVdata or the high grayscale data voltage HVdata is charged in the storage capacitor Cst in the upper sub pixel SPa. Further, the voltage of the gate electrode of the driving transistor DTR of the upper sub pixel SPa may be charged to the sum of the high potential power voltage VDD and the threshold voltage Vth by means of the turned-on second transistor TR2 from the reference voltage Vref.

From the fourth timing t4 to the fifth timing t5, one of the low grayscale data voltage LVdata and the high grayscale data voltage HVdata is charged in the storage capacitor Cst of the lower sub pixel SPb. From the fifth timing t5 to the sixth timing t6, the other one of the low grayscale data voltage LVdata and the high grayscale data voltage HVdata is charged in the storage capacitor Cst of the lower sub pixel SPb. Accordingly, from the fourth timing t4 to the fifth timing t5, the voltage of the gate electrode of the driving transistor DTR of the lower sub pixel SPb may be charged to the sum of the high potential power voltage VDD and the threshold voltage Vth from the reference voltage Vref. Further, from the fifth timing t5 to the sixth timing t6, any one of the low grayscale data voltage LVdata and the high grayscale data voltage HVdata is charged in the storage capacitor Cst of the lower sub pixel SPb. However, the voltage of the gate electrode of the driving transistor DTR may be continuously charged by the sum of the high potential power voltage VDD and the threshold voltage Vth.

Finally, at a seventh timing t7, a low level of emission control signal is output to the emission control signal line of the n-th row EM(n) and at an eighth timing t8, a low level of emission control signal is output to the emission control signal line of the n+1-th row EM(n+1). From the seventh timing t7, the third transistor TR3 and the fourth transistor TR4 of the upper sub pixel SPa are turned on to transmit a driving current to the light emitting diode EL. From the eighth timing t8, the third transistor TR3 and the fourth transistor TR4 of the lower sub pixel SPb are turned on to transmit a driving current to the light emitting diode EL. Accordingly, from the seventh timing t7, the light emitting diode EL of the upper sub pixel SPa may emit light and from the eighth timing t8, the light emitting diode EL of the lower sub pixel SPb may emit light. Accordingly, the upper sub pixel SPa causes the light emitting diode EL to emit light from the seventh timing t7 to display a gray scale corresponding to one of the low grayscale data voltage LVdata and the high grayscale data voltage HVdata. The lower sub pixel SPb causes the light emitting diode EL to emit light from the eighth timing t8 to display a gray scale corresponding to the other one of the low grayscale data voltage LVdata and the high grayscale data voltage HVdata.

In the meantime, in FIGS. 9 and 10, it has been described that the upper sub pixel SPa and the lower sub pixel SPb emit light at different timings. However, as described with reference to FIGS. 6 and 7, the upper sub pixel SPa and the lower sub pixel SPb are connected to the same common emission control signal line EM(n/n+1) to simultaneously emit light, but it is not limited thereto.

In the meantime, as in the display device 900 according to still another example embodiment of the present disclosure, when one sub pixel SP includes six transistors and one storage capacitor Cst, the upper sub pixel SPa and the lower sub pixel SPb may be driven without being limited to an output order of the low grayscale data voltage LVdata and the high grayscale data voltage HVdata.

Specifically, referring to FIG. 11A, the high grayscale data voltage HVdata is charged in the upper sub pixel SPa first, and then the low grayscale data voltage LVdata may be easily charged in the lower sub pixel SPb.

First, at the third timing t3, the low level of scan signal is output to the first scan line of the n-th row SL1(*n*) to output the high grayscale data voltage HVdata to the first node N1 of the upper sub pixel SPa. Accordingly, a voltage of the first node N1 of the upper sub pixel SPa may be charged to the high grayscale data voltage HVdata from the reference voltage Vref. Simultaneously, the voltage of the gate electrode of the driving transistor DTR of the upper sub pixel SPa may be charged with the sum of the high potential power voltage VDD and the threshold voltage Vth by the turned-on second transistor TR2.

Next, at the fourth timing t4, the low level of scan signal is output to the first scan line of the n+1-th row SL1(*n*+1) to output the high grayscale data voltage HVdata to the first node N1 of the lower sub pixel SPb. The voltage of the first node N1 of the lower sub pixel SPb is charged to the high grayscale data voltage HVdata from the reference voltage Vref. The voltage of the gate electrode of the driving transistor DTR of the lower sub pixel SPb may be charged with the sum of the high potential power voltage VDD and the threshold voltage Vth.

Next, the low grayscale data voltage LVdata is output to the data line DL from the fifth timing t5 to output the low grayscale data voltage LVdata to the first node N1 of the lower sub pixel SPb. Accordingly, the voltage of the first node N1 of the lower sub pixel SPb is changed from the reference voltage Vref to the high grayscale data voltage HVdata and then may be changed from the high grayscale data voltage HVdata to the low grayscale data voltage LVdata. However, even though the data voltage Vdata applied to the first node N1 is changed, the voltage of the gate electrode of the driving transistor DTR may be continuously maintained to be the sum of the high potential power voltage VDD and the threshold voltage Vth. Accordingly, even though the high grayscale data voltage HVdata is output first and then the low grayscale data voltage LVdata is output, the threshold voltage Vth of the driving transistor DTR of each of the upper sub pixel SPa and the lower sub pixel SPb may be normally sampled.

Next, referring to FIG. 11B, the low grayscale data voltage LVdata is charged in the upper sub pixel SPa first, and then the high gray scale data voltage HVdata may be easily charged in the lower sub pixel SPb.

At the third timing t3, the low level of scan signal is output to the first scan line of the n-th row SL1(*n*) so that the voltage of the first node N1 of the upper sub pixel SPa may be charged to the low grayscale data voltage LVdata from the reference voltage Vref. Simultaneously, the voltage of the gate electrode of the driving transistor DTR of the upper sub pixel SPa may be charged with the sum of the high potential power voltage VDD and the threshold voltage Vth by the turned-on second transistor TR2.

Next, at the fourth timing t4, the low level of scan signal is output to the first scan line of the n+1-th row SL1(*n*+1) to output the low grayscale data voltage LVdata to the first node N1 of the lower sub pixel SPb. The voltage of the first node N1 of the lower sub pixel SPb is charged to the low grayscale data voltage LVdata from the reference voltage Vref. The voltage of the gate electrode of the driving transistor DTR of the lower sub pixel SPb may be charged with the sum of the high potential power voltage VDD and the threshold voltage Vth.

Next, the high grayscale data voltage HVdata is output to the data line DL from the fifth timing t5 to output the high grayscale data voltage HVdata to the first node N1 of the lower sub pixel SPb. Accordingly, the voltage of the first node N1 of the lower sub pixel SPb is changed from the reference voltage Vref to the low grayscale data voltage LVdata and then may be changed from the low grayscale data voltage LVdata to the high grayscale data voltage HVdata. However, even though the data voltage Vdata applied to the first node N1 is changed, the voltage of the gate electrode of the driving transistor DTR is continuously maintained to be the sum of the high potential power voltage VDD and the threshold voltage Vth. Accordingly, even though the low grayscale data voltage LVdata is output first and then the high grayscale data voltage HVdata is output, the threshold voltage Vth of the driving transistor DTR of each of the upper sub pixel SPa and the lower sub pixel SPb may be normally sampled.

Accordingly, in the display device 900 according to still another example embodiment of the present disclosure, a circuit of each sub pixels SP is configured to charge the voltage of the gate electrode of the driving transistor DTR with the sum of the high potential power voltage VDD and the threshold voltage Vth. Therefore, the upper sub pixel SPa and the lower sub pixel SPb may be driven without being limited to the input order of the high grayscale data voltage HVdata and the low grayscale data voltage LVdata. First, each of the upper sub pixel SPa and the lower sub pixel SPb includes a circuit configured by six transistors and one storage capacitor Cst. At this time, when the data voltage Vdata is input, the voltage of the gate electrode of the driving transistor DTR is charged with the sum of the high potential power voltage VDD and the threshold voltage Vth. Accordingly, the driving transistor DTR may be suppressed from being turned off according to the output order of the high grayscale data voltage HVdata and the low grayscale data voltage LVdata. As a result, in the display device 900 according to another example embodiment of the present disclosure, when two gray scales are composed to display one gray scale, both the upper sub pixel SPa and the lower sub pixel SPb may be normally driven without being limited to the output order of the high grayscale data voltage HVdata and the low grayscale data voltage LVdata.

The example embodiments of the present disclosure can also be described as follows:

According to an aspect of the present disclosure, there is provided a display device. The display device includes a display panel which includes sub pixels configured by an upper sub pixel and a lower sub pixel which share a data line and are adjacent to each other, and a data driver which converts only image data corresponding to any one of even-numbered grayscale levels and odd-numbered grayscale levels among 10-bit image data into a data voltage to supply the converted data voltage to the sub pixel. When the data driver converts only the even-numbered grayscale levels of image data into the data voltage and the sub pixel displays an X (X is an odd number) grayscale level, the data driver supplies an X−1 grayscale level of data voltage to the upper sub pixel and supplies an X+1 grayscale level of data voltage to the lower sub pixel.

When the data driver converts only the even-numbered grayscale levels of image data into the data voltage and the sub pixel displays the even-numbered grayscale levels, the data driver may supply the data voltage of the even-numbered grayscale levels to the upper sub pixel and the lower sub pixel.

When the data driver converts only the odd-numbered grayscale levels of image data into the data voltage and the sub pixel displays an Y (Y is an even number) grayscale level, the data driver may supply a Y−1 grayscale level of data voltage to the upper sub pixel and supplies an Y+1 grayscale level of data voltage to the lower sub pixel.

The data driver may include a digital to analog converter which converts a 9-bit digital signal into the data voltage.

The 9-bit digital signal which is converted in the digital to analog converter may correspond to any one of an even-numbered grayscale level or an odd-numbered grayscale level of image data, among 10-bit image data.

The sub pixel may display 0 to 1023 grayscale levels obtained by composing a gray scale displayed in the upper sub pixel and a gray scale displayed in the lower sub pixel.

A period in which the data voltage is input to the upper sub pixel and a period in which the data voltage is input to the lower sub pixel may partially overlap.

The display device may further include a driving transistor which is disposed in each of the upper sub pixel and the lower sub pixel. When the X−1 grayscale level of data voltage is input to the upper sub pixel and the X+1 grayscale level of data voltage is input to the lower sub pixel, a voltage of a gate electrode of the driving transistor of the upper sub pixel may be a sum of the X−1 grayscale level of data voltage and a threshold voltage and a voltage of a gate electrode of the driving transistor of the lower sub pixel may be changed from the sum of the X−1 grayscale level of data voltage and a threshold voltage to a sum of the X+1 grayscale level of data voltage and the threshold voltage.

The data driver may input the X−1 grayscale level of data voltage to the upper sub pixel and the lower sub pixel and then input the X+1 grayscale level of data voltage only to the lower sub pixel.

The display device may further include a driving transistor which is disposed in each of the upper sub pixel and the lower sub pixel. When the X−1 grayscale level of data voltage is input to the upper sub pixel and the X+1 grayscale level of data voltage is input to the lower sub pixel, a voltage of a gate electrode of the driving transistor of the upper sub pixel may be a sum of a high potential power voltage and a threshold voltage, and a voltage of a gate electrode of the driving transistor of the lower sub pixel may be a sum of a high potential power voltage and a threshold voltage.

The display device may further include a storage capacitor which is connected to the gate electrode of the driving transistor in each of the upper sub pixel and the lower sub pixel. When the X−1 grayscale level of data voltage is input to the upper sub pixel and the X+1 grayscale level of data voltage is input to the lower sub pixel, the X−1 grayscale level of data voltage may be input to one end of the storage capacitor of the upper sub pixel, and after inputting the X−1 grayscale level of data voltage to one end of the storage capacitor of the lower sub pixel, the X+1 grayscale level of data voltage may be input.

The display device may further include an emission control signal line connected to each of the upper sub pixel and the lower sub pixel. The emission control signal line connected to the upper sub pixel may output an emission control signal earlier than the emission control signal line connected to the lower sub pixel.

The display device may further include a common emission control signal line which is commonly connected to the upper sub pixel and the lower sub pixel. The upper sub pixel and the lower sub pixel may simultaneously emit light based on the emission control signal from the common emission control signal line.

According to another aspect of the present disclosure, there is provided a display device. The display device includes a display panel which includes sub pixels configured by an upper sub pixel and a lower sub pixel which share a data line and are adjacent to each other and displays an image based on n-bit image data input from the outside (n is a natural number). Only some image data among the n-bit image data input from the outside is converted into m-bit image data (m is a natural number smaller than n) to be output to the upper sub pixel and the lower sub pixel and the sub pixels configured by the upper sub pixel and the lower sub pixel display gray scale corresponding to the n-bit image data.

When each of the upper sub pixel and the lower sub pixel displays a specific or selected gray scale, the specific or selected gray scale may be displayed in the sub pixel.

When the upper sub pixel displays a gray scale lower than a specific or selected gray scale and the lower sub pixel displays a gray scale higher than the specific or selected gray scale, the lower gray scale and the higher gray scale may be composed to display the specific or selected gray scale in the sub pixel.

The n-bit image data may be 10-bit image data and the m-bit image data may be 9-bit image data.

Each of 512 even-numbered grayscale levels, among 0 to 1023 grayscale levels corresponding to the 10-bit image data, may be converted into each of 0 to 511 levels of the 9-bit image data to be output to the upper sub pixel and the lower sub pixel.

When the sub pixel displays odd-numbered grayscale levels, among 0 to 1023 grayscale levels corresponding to the 10-bit image data, an even-numbered grayscale level of data voltage which is lower than the odd-numbered grayscale level may be output to the upper sub pixel and an even-numbered grayscale level of data voltage which is higher than the odd-numbered grayscale level may be output to the lower sub pixel.

Wherein each of 512 odd-numbered grayscale levels, among 0 to 1023 grayscale levels corresponding to the 10-bit image data, may be converted into each of 0 to 511 levels of the 9-bit image data to be output to the upper sub pixel and the lower sub pixel.

When the sub pixel displays even-numbered grayscale levels, among 0 to 1023 grayscale levels corresponding to the 10-bit image data, an odd-numbered grayscale level of data voltage which is lower than the even-numbered grayscale level may be output to the upper sub pixel and an odd-numbered grayscale level of data voltage which is higher than the even-numbered grayscale level may be output to the lower sub pixel.

Although the example embodiments of the present disclosure have been described in detail with reference to the accompanying drawings, the present disclosure is not limited thereto and may be embodied in many different forms without departing from the technical concept of the present disclosure. Therefore, the example embodiments of the present disclosure are provided for illustrative purposes only but not intended to limit the technical concept of the present disclosure. The scope of the technical concept of the present disclosure is not limited thereto. Therefore, it should be understood that the above-described example embodiments are illustrative in all aspects and do not limit the present disclosure. The protective scope of the present disclosure should be construed based on the following claims, and all the technical concepts in the equivalent scope thereof should be construed as falling within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a display panel which includes a plurality of sub pixels, each of the plurality of sub pixels including an upper sub pixel and a lower sub pixel which share a data line and are adjacent to each other; and a data driver which converts only image data corresponding to any one of even-numbered grayscale levels and odd-numbered grayscale levels among 10-bit image data into a converted data voltage, and supplies the converted data voltage to the plurality of sub pixels, wherein when the data driver converts only the even-numbered grayscale levels of the image data into the converted data voltage and a sub pixel of the plurality of sub pixels displays an X grayscale level, the data driver supplies an X−1 gray scale level of data voltage to the upper sub pixel and supplies an X+1 grayscale level of the data voltage to the lower sub pixel, and wherein X is an odd number.

2. The display device according to claim 1, wherein when the data driver converts only the even-numbered grayscale levels of the image data into the data voltage and the sub pixel displays the even-numbered grayscale levels, the data driver supplies the data voltage of the even-numbered grayscale levels to the upper sub pixel and the lower sub pixel.

3. The display device according to claim 1, wherein when the data driver converts only the odd-numbered grayscale levels of the image data into the data voltage and the sub pixel displays a Y grayscale level, Y being an even number, the data driver supplies a Y−1 grayscale level of the data voltage to the upper sub pixel and supplies an Y+1 grayscale level of the data voltage to the lower sub pixel.

4. The display device according to claim 1, wherein the data driver includes a digital to analog converter which converts a 9-bit digital signal into the data voltage.

5. The display device according to claim 4, wherein the 9-bit digital signal which is converted in the digital to analog converter corresponds to any one of an even-numbered grayscale level or an odd-numbered grayscale level of the image data, among the 10-bit image data.

6. The display device according to claim 4, wherein the sub pixel displays 0 to 1023 grayscale levels obtained by composing a gray scale displayed in the upper sub pixel and a gray scale displayed in the lower sub pixel.

7. The display device according to claim 1, wherein a period in which the data voltage is input to the upper sub pixel and a period in which the data voltage is input to the lower sub pixel partially overlap.

8. The display device according to claim 7, further comprising:

a driving transistor disposed in each of the upper sub pixel and the lower sub pixel, wherein when the X−1 grayscale level of the data voltage is input to the upper sub pixel and the X+1 grayscale level of the data voltage is input to the lower sub pixel, a voltage of a gate electrode of the driving transistor of the upper sub pixel is a sum of the X−1 grayscale level of the data voltage and a threshold voltage and a voltage of a gate electrode of the driving transistor of the lower sub pixel is changed from the sum of the X−1 grayscale level of the data voltage and a threshold voltage to a sum of the X+1 grayscale level of the data voltage and the threshold voltage.

9. The display device according to claim 8, wherein the data driver inputs the X−1 grayscale level of the data voltage to the upper sub pixel and the lower sub pixel and then inputs the X+1 grayscale level of the data voltage only to the lower sub pixel.

10. The display device according to claim 7, further comprising:

a driving transistor which is disposed in each of the upper sub pixel and the lower sub pixel, wherein when the X−1 grayscale level of the data voltage is input to the upper sub pixel and the X+1 grayscale level of the data voltage is input to the lower sub pixel, a voltage of a gate electrode of the driving transistor of the upper sub pixel is a sum of a high potential power voltage and a threshold voltage, and a voltage of a gate electrode of the driving transistor of the lower sub pixel is a sum of the high potential power voltage and the threshold voltage.

11. The display device according to claim 10, further comprising:

a storage capacitor connected to the gate electrode of the driving transistor in each of the upper sub pixel and the lower sub pixel, wherein when the X−1 grayscale level of the data voltage is input to the upper sub pixel and the X+1 grayscale level of the data voltage is input to the lower sub pixel, the X−1 grayscale level of the data voltage is input to one end of the storage capacitor of the upper sub pixel, and after inputting the X−1 grayscale level of the data voltage to one end of the storage capacitor of the lower sub pixel, the X+1 grayscale level of the data voltage is input.

12. The display device according to claim 1, further comprising:

an emission control signal line connected to each of the upper sub pixel and the lower sub pixel, wherein the emission control signal line connected to the upper sub pixel outputs an emission control signal earlier than the emission control signal line connected to the lower sub pixel.

13. The display device according to claim 1, further comprising:

a common emission control signal line which is commonly connected to the upper sub pixel and the lower sub pixel, wherein the upper sub pixel and the lower sub pixel simultaneously emit light based on the emission control signal from the common emission control signal line.

14. A display device, comprising:

a display panel which includes a plurality of sub pixels, each of the plurality of sub pixels including an upper sub pixel and a lower sub pixel which share a data line and are adjacent to each other, the display panel, in operation, displaying an image based on n-bit image data input from outside the display panel, n being a natural number, wherein only some image data among the n-bit image data is converted into m-bit image data to be output to the upper sub pixel and the lower sub pixel, and the plurality of sub pixels display gray scale corresponding to the n-bit image data, and wherein m is a natural number smaller than n.

15. The display device according to claim 14, wherein when each of the upper sub pixel and the lower sub pixel displays a selected gray scale, the selected gray scale is displayed in the sub pixel.

16. The display device according to claim 14, wherein when the upper sub pixel displays a gray scale lower than a selected gray scale and the lower sub pixel displays a gray scale higher than the selected gray scale, the lower gray scale and the higher gray scale are composed to display the selected gray scale in the sub pixel.

17. The display device according to claim 14, wherein the n-bit image data is 10-bit image data and the m-bit image data is 9-bit image data.

18. The display device according to claim 17, wherein each of 512 even-numbered grayscale levels, among 0 to 1023 grayscale levels corresponding to the 10-bit image data, is converted into each of 0 to 511 grayscale levels of the 9-bit image data to be output to the upper sub pixel and the lower sub pixel.

19. The display device according to claim 18, wherein when the sub pixel displays odd-numbered grayscale levels, among 0 to 1023 grayscale levels corresponding to the 10-bit image data, an even-numbered grayscale level of data voltage which is lower than the odd-numbered grayscale level is output to the upper sub pixel and an even-numbered grayscale level of the data voltage which is higher than the odd-numbered grayscale level is output to the lower sub pixel.

20. The display device according to claim 17, wherein each of 512 odd-numbered grayscale levels, among 0 to 1023 grayscale levels corresponding to the 10-bit image data, is converted into each of 0 to 511 levels of the 9-bit image data to be output to the upper sub pixel and the lower sub pixel.

21. The display device according to claim 20, wherein when the sub pixel displays even-numbered grayscale levels, among 0 to 1023 grayscale levels corresponding to the 10-bit image data, an odd-numbered grayscale level of data voltage which is lower than the even-numbered grayscale level is output to the upper sub pixel and an odd-numbered grayscale level of the data voltage which is higher than the even-numbered grayscale level is output to the lower sub pixel.

* * * * *